United States Patent [19]

Widmayer

[11] 4,394,603

[45] Jul. 19, 1983

[54] ENERGY CONSERVING AUTOMATIC LIGHT OUTPUT SYSTEM

[75] Inventor: Don F. Widmayer, Bethesda, Md.

[73] Assignee: Controlled Environment Systems Inc., Rockville, Md.

[21] Appl. No.: 250,410

[22] Filed: Apr. 2, 1981

Related U.S. Application Data

[63] Continuation of Ser. No. 945,842, Sep. 26, 1978, abandoned, which is a continuation-in-part of Ser. No. 849,427, Nov. 7, 1977, abandoned.

[51] Int. Cl.[3] ..... H05B 41/16; H05B 41/36

[52] U.S. Cl. ..... 315/311; 315/105; 315/151; 315/158; 315/171; 315/205; 315/307; 315/DIG. 7

[58] Field of Search ..... 315/151, 152, 158, 205, 315/287, 307, 311, 105, DIG. 7, 171

[56] References Cited

U.S. PATENT DOCUMENTS

| | | | |
|---|---|---|---|
| 2,975,331 | 3/1961 | Diaz et al. | 362/221 X |
| 3,093,319 | 6/1963 | Gamain | 362/1 |
| 3,114,283 | 12/1963 | Gruner | 355/1 |
| 3,222,572 | 12/1965 | Powell | 315/151 |
| 3,422,309 | 1/1969 | Spira et al. | 315/194 |
| 3,471,747 | 10/1969 | Gershen | 315/205 |
| 3,479,560 | 11/1969 | Paget et al. | 315/105 |
| 3,482,142 | 12/1969 | Cluett et al. | 315/105 |
| 3,649,118 | 3/1972 | Yano et al. | 355/38 |
| 3,681,654 | 8/1972 | Quinn | 315/151 |
| 3,731,142 | 5/1973 | Spira et al. | 315/200 R X |
| 3,857,063 | 12/1974 | Major et al. | 315/205 X |
| 3,909,666 | 9/1975 | Tenen | 315/209 R X |
| 3,935,505 | 1/1976 | Spiteri | 315/194 |
| 3,940,659 | 2/1976 | Kojima et al. | 315/151 X |
| 4,009,387 | 2/1977 | Nuver | 315/158 X |
| 4,039,897 | 8/1977 | Dragoset | 315/DIG. 5 |
| 4,042,853 | 8/1977 | Duve | 315/155 |
| 4,066,930 | 1/1978 | Summa | 315/209 R |
| 4,081,718 | 3/1978 | Kaneda | 315/DIG. 5 |
| 4,092,564 | 5/1978 | Soileau | 315/200 R X |

FOREIGN PATENT DOCUMENTS

| | | |
|---|---|---|
| 973520 | 10/1964 | United Kingdom . |
| 1147969 | 4/1969 | United Kingdom . |
| 1180755 | 2/1970 | United Kingdom . |
| 1308133 | 2/1973 | United Kingdom . |

OTHER PUBLICATIONS

Amick, *Fluorescent Lighting Manual,* Third Edition, McGraw-Hill, New York, 1960, pp. 80–85.

*Primary Examiner*—Eugene La Roche
*Attorney, Agent, or Firm*—Larson and Taylor

[57] ABSTRACT

An energy conserving lighting system is provided wherein a plurality of fluorescent lamps are powered by a poorly regulated voltage source power supply which provides a decreasing supply voltage with increasing arc current so as to generally match the volt-ampere characteristics of the lamps. A transistor ballast and control circuit connected in the arc current path controls the arc current, and hence the light output, in accordance with the total ambient light, i.e., the light produced by the lamps together with whatever further light is produced by other sources such as daylight. In another embodiment, a transistor ballast is utilized in combination with an inductive ballast. The transistor ballast provides current control over a wide dynamic range up to a design current maximum at which maximum the transistor is saturated and the inductive ballast takes over the current limiting function. An operational amplifier is preferably connected in the base biassing circuit of the control transistor of the transistor ballast. In an embodiment wherein two sets of lamps with separate inductive ballasts are provided, the arc currents for the two ballasts are scaled or matched to provide the desired light output.

42 Claims, 15 Drawing Figures

ENERGY CONSERVING AUTOMATIC LIGHT OUTPUT SYSTEM

CROSS-REFERENCE TO RELATED APPLICATIONS

This application is a continuation of my copending U.S. patent application Ser. No. 945,842, filed on Sept. 26, 1978, and entitled "Energy Conserving Automatic Light Output System", now abandoned, which is, in turn, a continuation-in-part of my copending U.S. patent application Ser. No. 849,427, filed on Nov. 7, 1977 and entitled "Energy Conserving Automatic Light Output System", now abandoned.

FIELD OF THE INVENTION

The present invention relates to light control systems for illumination purposes and the like.

BACKGROUND OF THE INVENTION

Because the problems associated with conventional lighting systems using fluorescent lamps are not always fully understood, a brief description of such systems and the nature of fluorescent lamps in particular will be considered by way of background. It should be noted that some of this discussion will be continued below after the invention has been summarized because the points raised are best explained in connection with a drawing.

A fluorescent lamp, in contrast to the incandescent lamp, is an area source rather than a point source. In terms of light output, for a given amount of electrical power, the fluorescent lamp is three or four times more efficient than the incandescent lamp. The name "fluorescent" lamp is derived from the fact that an electric arc conducting through ionized mercury vapor or gas within the lamp emits ultraviolet photons which impinge on an interior coating of phosphor that then radiates or "fluoresces" longer wave length visible light photons.

Critical to the operation referred to is the conduction of an electrical current through the mercury vapor. The volt-ampere characteristics of this conduction are determined by a number of complex phonomena which lack simple definition. As discussed hereinbelow, the current in the arc discharge region of operation will continue to increase to disastrous levels unless limited by external means. In order to provide this current limiting, devices commonly known as ballasts are employed. In general, for AC operation, inductive ballasts are used, while for DC operation, resistive ballasts are generally employed. Transistor ballasts can be also used but these are impractical for most applications as explained in more detail below. Further, and more generally, resistive ballasting requires a substantial increase in power over that required by the lamp alone and systems enploying such ballasting are highly dissipative and energy inefficient.

A further problem associated with lamps such as are being discussed is that of providing adjustment of the light level in an effective, practical way. In general, both inductive and resistive ballasts simply limit the current to a design value although, as discussed below, there are ballast circuits which are specifically designed to enable adjustment of the arc current.

Another operational problem associated with fluorescent lamps is starting the lamps. In essence, the mercury within a flourescent lamp must be ionized before conduction can occur. This can be accomplished by momentarily applying a high voltage to the electrodes. If the lamps have heated electrodes, the ionizing or starting voltage is reduced. For this reason, the more common "rapid start" lamps have cathodes which are excited by separate transformer windings. Another type of fluorescent lamp is the "pre-heat" lamp which has a switch mechanism in the ballast circuit that momentarily closes or is closed upon energization so that a current flows through the lamp cathode and the inductor. The switch then opens, and due to the stored inductive energy, a voltage transient is also generated. The voltage transient coupled with the hot cathodes causes the lamp arc to conduct. Since the preheated electrodes are not externally heated after firing, preheat lamps are designed so that once the lamp is fired the rated arc current keeps the electrodes hot enough to emit electrons and to keep deleterious material from collecting on the cathodes.

A third group of lamps are the so-called "instant start" lamps. The cathodes of these lamps are designed for cold starting and the ballast circuit simply provides a sufficiently high starting voltage to cause conduction to be initiated by what is called high field emission. Once the lamp is started the rated arc current keeps the cathodes hot enough to provide emission and to boil off any contaminating materials. It is noteworthy that neither the instant start nor preheat lamps can be dimmed because these lamps are designed to use the arc current in order to keep there cathodes at a "liveable" temperature. When these lamps are used in a dimming mode, the cathode temperature is lowered and the lamp ends are blackened by material sputtering off the cathode so that, finally, the cathode is used up and the lamp ceases to function.

A further problem associated with fluorescent lamps is that of the decline in lumen output with usage. This decline is primarily caused by wear of the phosphor. Changes in temperature will also affect the lumen output. As explained in more detail hereinbelow, because of the phosphor decay problem, lighting systems are characteristically designed to initially overlight the associated area so that sufficient minimum light is provided as the light output decreases with lamp use. This approach results in a very substantial waste of energy. This problem, and other aspects thereof, as well as other problems associated with fluorescent lamps, are also considered below.

Patents of interest in this general field include some of my earlier patents, viz., U.S. Pat. Nos. 3,422,310 (Widmayer), 3,781,598 (Widmayer), 3,876,907 (Widmayer), as well as 3,531,684 (Nuckolls), 3,609,451 (Edgerly, Jr. et al), 3,801,867 (West et al), 4,012,663 (Soileau) and 3,909,666 (Tenen) the latter of which is discussed below.

SUMMARY OF THE INVENTION

In accordance with the invention, a light control system for fluorescent and like lamps is provided which affords very substantial energy savings. According to one aspect of the invention, a system is provided which enables the lumen output of the fluorescent lamps to be controlled so as to provide a minimum level of room light and to be adjusted inversely proportional to the amount of light present from other sources, including daylight. Thus, according to this aspect of the invention, a system is provided wherein light is the controlled variable rather that lamp current.

According to a further aspect of the invention, fluorescent lamps are driven from a voltage source power supply which is intentionally poorly voltage regulated so that the supply voltage is reduced in a non-dissipative manner simultaneously with the reduced voltage requirements of the lamps when operating in the arc discharge region. This voltage supply, in combination with a transistor ballast and control circuit, serves as a voltage-compliant current source for the lamps whereby the power supply is more closely matched to the lamp requirements. This combination minimizes the amount of power dissipated by the ballasting transistor while operating in the active region thereof and also provides intrinsic current limiting when the ballast transistor is saturated.

In a first embodiment of the invention, the poorly regulated power supply referred to above is utilized in combination with a solid state electronic control device (ballast transistor) connected in the D.C. arc current path of the lamps. A light sensing means is provided for sensing the level of ambient light in the area of the lamps, this total including the light output of the lamps and the ambient light produced by any other light sources including sunlight. A feedback means connected between the electronic device and the light sensing means controls the conduction of said electronic device and thus the current flow in the arc current path in accordance with the output of the light sensing means so as to maintain the total ambient light substantially constant. The poorly regulated power supply comprises a voltage multiplying rectifier circuit utilizing diodes and capacitors. An ionizing supply circuit is also provided which supplies the starting or firing voltage for the lamps and which automatically provides a negligible low voltage when the lamps are fired. The ionizing supply circuit also comprises a voltage multiplying rectifier circuit employing diodes and capacitors.

In accordance with a second embodiment of the invention, a transistor ballasting and control circuit similar to that described above is incorporated in lighting systems which include an inductive ballast. It will be appreciated that millions of such inductively ballasted lighting systems are presently in existence, and the inclusion of the transistor ballasting and control circuit in combination with the inductive ballast provides substantial energy savings. The two ballasts are operable selectively and automatically, with the transistor ballast being the operating current limiting ballast over the dynamic range of current control from a given minimum up to a design current maximum and being automatically superseded by the inductive ballast at that current maximum when the control transistor is saturated. More specifically, the ballast transistor saturates at the current maximum and the inductive ballast serves its conventional function of current limiting only at this time, i.e., with the transistor saturated. The inductive ballast also provides a high firing voltage during "start up" as well as the sustaining operating voltage. The presence of the inductive ballast also prevents the transistor from having to pick up and dissipate all of the power associated with the excess voltage resulting from the negative volt-ampere characteristics of the lamps. Because the transistor operates as the current limiter during a portion of the "on" time of the lamps, the $I^2R$ losses of the inductive ballast are substantially reduced and consequently, the life of the ballast can be expected to be extended.

In accordance with a preferred embodiment of the invention as applied to lighting system including a conventional ballast, an operational amplifier is connected in the biassing circuit of the control transistor of the transistor ballast. One input of the operational amplifier is connected to receive a light feedback signal while another is connected to variable voltage reference supply such as potentiometer or a programmed voltage input. In addition, a minimum biassing signal is preferably provided for the control transistor.

In accordance with a further embodiment of the invention, a system is provided wherein at least first and second sets of lamps are used, each having an individual reactive ballast associated therewith. The system includes a control unit such as discussed above in combination with a follower circuit arrangement which provides for matching or scaling of the arc currents flowing in two ballasts so as to control the light output as desired. The follower circuit arrangement includes resistors connected in the emitter circuits of the control transistor of the control unit as well as a control transistor connected to the second ballast. In a preferred embodiment, an operational amplifier arrangement is provided which affords precise control of the arc current flow for each of the two (or more) ballasts.

Other features and advantages of the invention will be set forth in, or apparent from, the detailed description of the preferred embodiment found hereinbelow.

DESCRIPTION OF THE PREFERRED EMBODIMENTS

Figure 1:
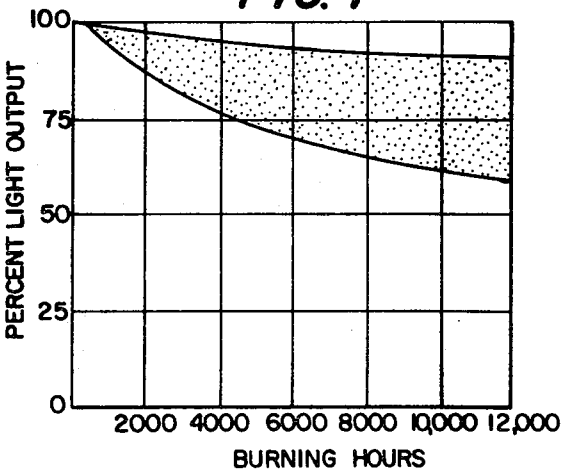
FIG. 1 is a graph plotting light output as a function of hours in use for a fluorescent lamp.

Before considering the preferred embodiments of the invention, some of the points raised in the foregoing background discussion of the invention will be considered in more detail. Thus, as stated above, because of the phosphor decay problem associated with fluorescent lamp, a design criteria that establishes the need for, e.g., seventy foot candle (70 FC) lighting must be designed to initially over-light the area in order to meet the design criteria by taking into consideration the aging effects that occur before lamp replacement. Referring to FIG. 1, which is adapted from a graph used in the sales literature of a leading fluorescent lamp manufacturer and which therefore perhaps minimizes the problem, the light degradation over time of typical fluorescent lamps is shown. Two major causes of this degradation or decline relate directly to the density of the arc current. Specifically, an increase in arc current increases the amount of the deleterious 185 nanometer wavelength radiation impinging on the phosphors as well as the interaction between the mercury ions in the gas column and the phosphor molecules.

Figure 2:
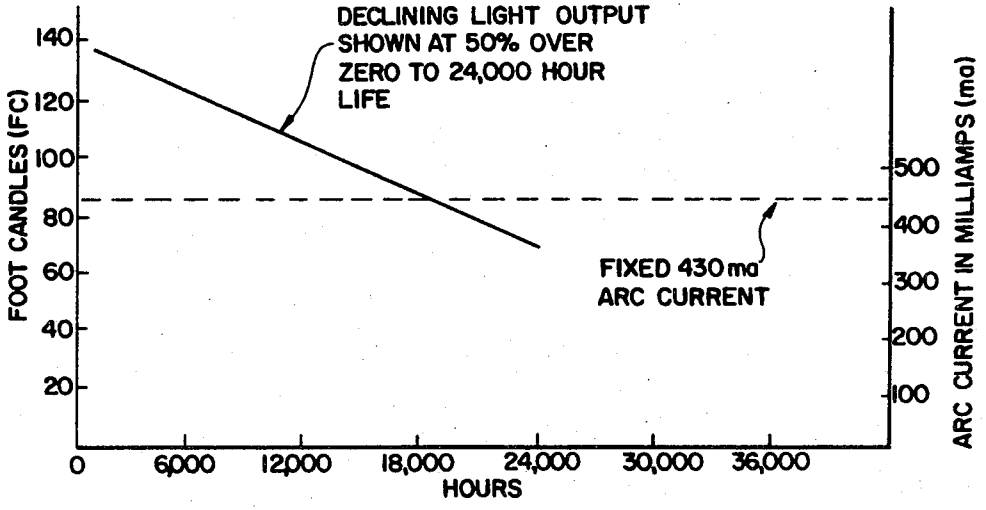
FIG. 2 is a graph illustrating the time operating characteristics of fixed arc current lighting systems.

It will be appreciated that any light over that which is required, i.e., any lumen output in excess of 70 FC, can be said to waste electrical power. To further illustrate this point, it will be assumed that a room is of such a size that a four lamp F40T12 fixture which, when operating with new lamps, will give 140 starting foot candles at some point. The lamps are driven by the standard 430 ma arc current inductive ballasts which provide a more or less fixed power consumption. Over time, while the arc current, with its related power consumption, remains reasonably constant, the light output declines as is shown graphically in FIG. 2. As explained hereinafter, one aspect of the present invention concerns control of the arc current as a function of a referenced level of the ambient or room light. Thus, referring to FIG. 3, this type of control is illustrated graphically for a constant light level over time of 70 FC with a starting arc current of 200 ma. Now as the phosphor decays (and the phosphor will decay more slowly at the lower arc level because of the lower UV and ion interaction level associated with the lower arc level), the provided control advances the arc current so as to maintain the light constant at the referenced level of 70 FC. Finally, it is noted that when the lamp is fully aged, the arc current has advanced more than that of the ballasted lamp example shown in FIG. 2.

Figure 3:
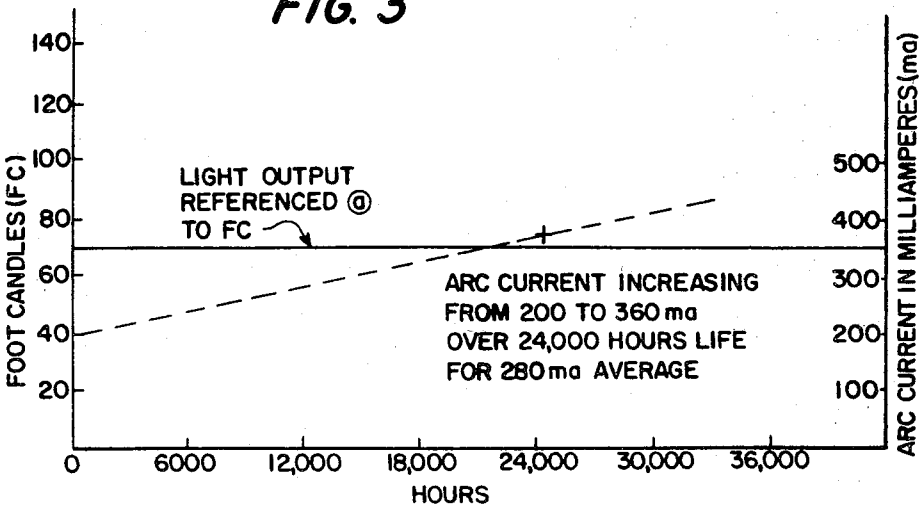
FIG. 3 is a graph illustrating the operating characteristics of a constant light output lighting system in accordance with the invention.

The electrical power consumed by a given fluorescent lamp bears a relationship to the level of its arc current. Because of the lower average arc current illustrated in FIG. 3, both the power consumed and the phosphor deterioration is less than for the technique illustrated in FIG. 2. FIG. 3 shows that at the 24,000 hour point the current has reached only 360 ma (with the average current from zero to 24,000 hours being 285 ma) as opposed to 430 ma in the case of FIG. 2. Thus, in addition to having the ability to adjust the referenced level of light and then hold this level constant over time, this approach permits immediate evaluation and variation in different areas to meet varying requirements. Before proceeding further, it should be pointed out that the light decline in FIG. 2 and the current increase in FIG. 3 are shown as being linear for purposes of clarity of illustration but that the same general relations hold true for curves closer to those actually found in practice.

As stated above, the arc control capability provided by the invention is a function of the room ambient light level. Accordingly, if the room referred to in the example has an outdoor window, daylight would enter the room at certain times of the day so that less light would be required from the lamps to maintain the relative 70 FC level. Thus, an even lower arc current would be required resulting in further, and even more substantial power savings. As mentioned, and as is explained in more detail hereinbelow, the system of the present invention possesses the arc current control capabilities discussed and thus provides the advantages which have been referred to.

Before discussing the combination of artificial and daylight lighting and the manner in which the present invention takes advantage of the combination, some brief comments on "daylighting"might be helpful. Daylight illumination is made of two components, viz., (i) illumination direct from the sun and, (ii) indirect solar illumination due to skylight. Rather than consider the actual sources it is probably simpler to view a window as if it were a piece of opal diffusing glass lighted by varying light sources on the outside. The illumination from the source or combination of sources will vary from zero during the night period up to several thousand lumans per square foot of window area in the day period. This wide variation is a function of the direct and indirect components which vary with weather conditions, the time of day and the season of the year. In any event, with arc control of the fluorescent lamp related to the room light level, the arc current is decreased or turned downwardly as the daylight increases and the lamp arc current is increased or turned upwardly as the daylight declines. The average arc over the time of a 12 hour day period with daylight available would be reduced to less than half required without such auxiliary lighting, on most days.

Figure 4:
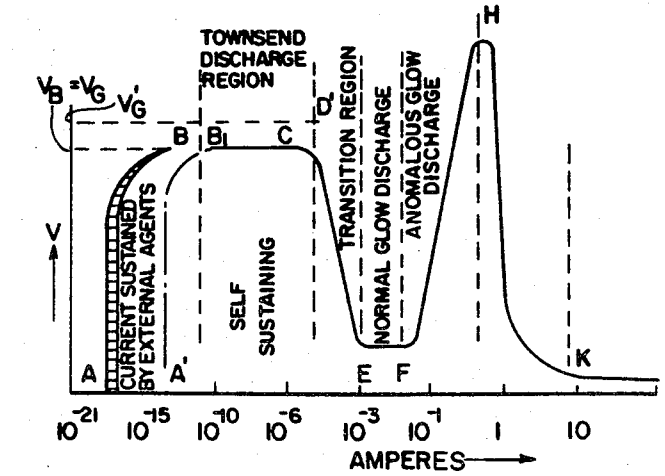
FIG. 4 is a graph illustrating the volt-ampere characteristics of a fluorescent (arc discharge) lamp.

Another area which was cursorily explored above and which will be considered in somewhat more detail now is that of the difficulty of controlling fluorescent lamps. The important problems in this area were mentioned above. The first is that the mercury within the lamp must be ionized, thereby, among other effects, lowering the resistance between the lamp electrodes from a virtually infinite level to a level where conduction is permitted through the ionized gas and hence the lamp is turned on. The second and most difficult problem to deal with is the phenomena in the conduction of electrical current through gas that occurs upon firing of the lamp. In this regard, it is stated by Condon and Odishaw in the text *Handbook on Physics,* at page 4174 that the phenomena associated with the conduction of an electrical coil arc discharge through gas defies rigorous definition. FIG. 4 is adapted from the same page of the text and shows a model of the volt-ampere characteristic of a gas discharge lamp. It will be seen that when the arc is struck the current, starting close to zero, traverses through the various discharge regions, the arc region. The last region is where gas discharge lamps used for lighting generally operate. Of significance is that the arc discharge region, shown in FIG. 4, does not follow Ohm's law. In fact, the voltage decreases, rather than increases, with an increase in current. This explains why fluorescent lamps are said to have negative resistance characteristics and means that if the lamp was energized with a voltage source and current conduction reached the arc discharge region, the current would continue to rise to a disastrous level.

If the commonly available AC power was provided as a fixed current-voltage compliant source, a fluorescent lamp might be connected and operated directly. However, because wall outlet or electrical distribution systems provide a fixed voltage-current compliant source, i.e., a source wherein the current adjusts to the positive resistance of the load, a fluorescent lamp requires an external means for stabilizing the arc current when driven from such power systems. Such a means is commonly referred to as a ballast as noted previously.

Most fluorescent lamps are operated with AC through one or more lamps connected in series with an inductor as the ballast element therefor. The reactance of the inductor becomes the limiting impedance and limits the amount of current in the series circuit. Except for second order effects, an inductive reactance ballast can be considered a non-dissipative current limiter. Capacitive reactance can also be employed as a non-dissipative ballast at high AC frequencies. However, at 60 Hertz the stored energy in the capacitors would discharge into the lamp as a highly peaked current due to the volt-ampere characteristics of the lamps unless the current is limited in some other way.

Direct current operation of fluorescent lamps is possible and such systems usually employ a resistance ballast at a higher supply or operation voltage. Such a ballast is dissipative and will often dissipate as much or more power than the lamp consumes in its lumen generating process. There are exceptions to this statement, an example being disclosed in U.S. Pat. No. Re. 28,044 (Widmayer) where a choke is used as a volt second integrator with other controls.

Figure 5:
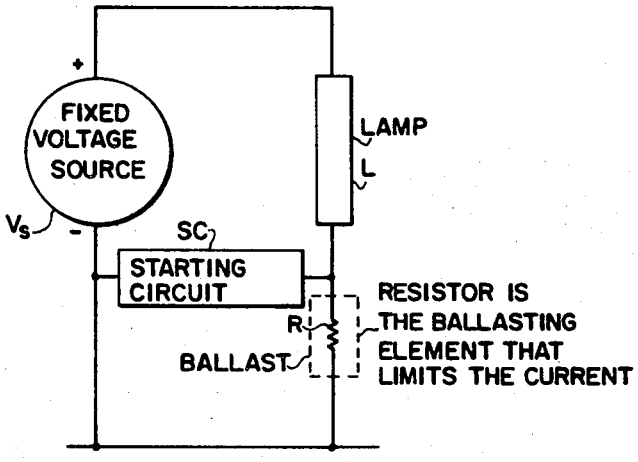
PRIOR ART FIG. 5
FIG. 5 is a highly schematic block circuit of a prior art lamp system employing a resistive ballast.
Figure 6:
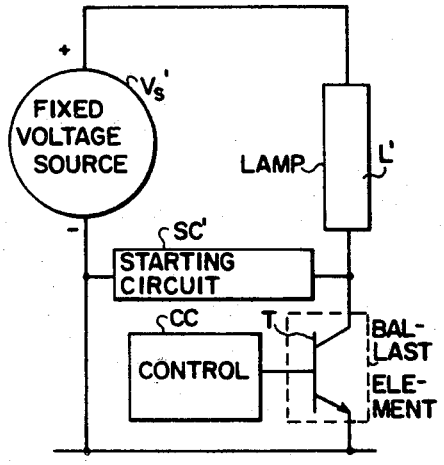
PRIOR ART FIG. 6
FIG. 6 is a highly schematic block circuit diagram of a prior art lamp system employing a transistor ballast.

Referring to FIGS. 5 and 6, two embodiments of a DC ballast are illustrated. The embodiment of FIG. 5 includes a lamp L connected across a fixed voltage source VS with a starting circuit SC connected between lamp L and source VS as shown. A resistor R is employed as the ballast. In this embodiment, the lamp L is fired and the current complies to a level more or less equal to the source voltage $E_S$ minus the fluorescent lamp voltage $E_L$ drop at current equilibrium, divided by the ballast resistance R $[I=(E_S-E_L)/R)]$.

The embodiment of FIG. 6 is similar to that of FIG. 5, and like elements are given the same designations with primes attached. As will be evident, the only difference between the embodiments of FIGS. 5 and 6 is that a transistor ballast is used in FIG. 6. The transistor ballast is formed by a transistor T which is controlled by a control circuit CC. It should be noted that the embodiment if FIG. 6 is not practical principally because in order to be an effective ballast, transistor T would have to operate in the linear region. The problem with such operation is that due to the negative volt-ampere characteristics of the lamp, the transistor T, acting as a control device, would have a rising current and an increasing collector-emitter voltage which would be clearly beyond the power dissipation capabilities of a transistor at practical fluorescent arc levels. Of course, a collector resistor (not shown) could be added to relieve the transistor T of some of the excess volts but such an approach would defeat the purpose of using a transistor and thus a variable resistance might just as well be used.

In general, both inductive and resistive ballasts simply limit the current to a design level and provide no light level adjustment. There are, however, specially designed ballast circuits that permit some manual adjustment of the arc current. The more commontypes include thyratrons, adjustable volage transformers and adjustable reactor circuits, among others, which vary the arc current amplitude and/or the current on-off time within the AC half wave so as to provide an apparent light change due to the averaging effect preceived by human vision.

Figure 7:
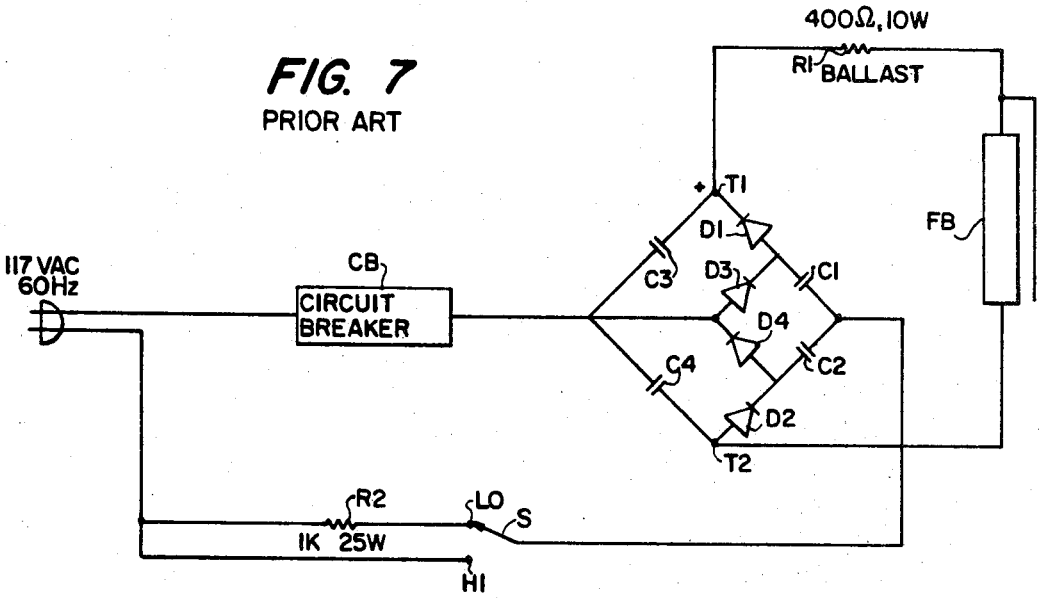
FIG. 7 PRIOR ART
FIG. 7 is a schematic circuit diagram of a further prior art lamp supply system employing resistive ballasting.

Referring to FIG. 7, an example of a prior art DC resistive ballast network is illustrated. FIG. 7 is adapted from the drawing in U.S. Pat. No. 3,909,606 (Tenan) and is of particular interest in that the input voltage circuit bears some resemblance to that of the invention. The Tenen patent describes the capacitors $C_1$ to $C_4$ and diodes $D_1$ to $D_4$ as forming a voltage quadrupler circuit. The patent states that when the switch arm of switch S is moved to the high or low position, the voltage output between terminals $T_1$ and $T_2$ is four times the peak input potential and that when fluorescent bulb FB ignites, most of the resulting increased current flows through lower impedance capacitors $C_1$ and $C_2$ so that the voltage increasing effect of trigger capacitors $C_3$ and $C_4$ becomes negligible. The current through fluorescent lamp FB is limited by ballast resistor R1 and dimmer resistor R2.

Figure 8:
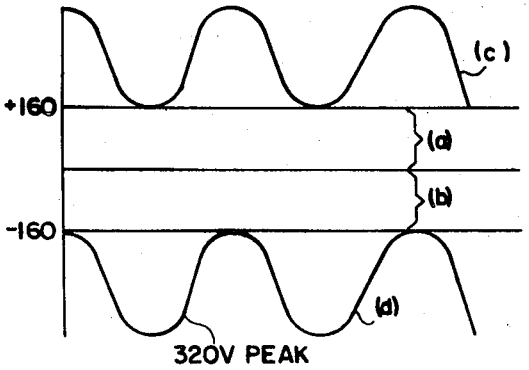
FIG. 8 is a diagram of a waveform associated with the circuit of FIG. 7.

The voltage input circuit of the Tenen patent is perhaps best understood as providing a plus and minus half-wave rectified DC voltage source wherein one half of a doubler output is added, (with the appropriate sign) to each wave. The waveform of the supply voltage at load would generally correspond to that shown in FIG. 8, wherein the positive half-wave provides the voltage indicated at (a), the minus half-wave provides voltage (b) and the voltages (c) and (d) result from the outputs of the one-half doubler circuit as added to the plus and minus supply voltages, respectively. It is important to note that because of the nature of the half wave doublers the waveforms (c) and (d) are out of phase. This is important since these voltages are used in building up the no load ionizing voltage which is required only momentarily in order to fire the lamps. Hence, one of the waveforms (c) or (d), and thus the components which produce that waveform, are unnecessary. It is also noted that a F13T5WW lamp is fired without preheating and thus may account for the use of four times the line peak (640 VDC no load) to fire a lamp that requires a starting voltage of 176 volts (rms) and an operating voltage of 95 volts (rms) (based on page 4 of the Westinghouse Fluorescent Lamp Service Manual 7/68 A-8072). Again, high voltage cold cathode firing of a pre-heat lamp is not practical when the lamp is to provide light for other than the short term.

The circuit of FIG. 7 clearly illustrates the need for dropping a considerable voltage across the resistors R1 and R2 since, in the specific example given, the line voltage is in excess of the 95 volt operating level the majority of the time in a given cycle, and the DC voltage is substantially in excess of the line voltage. It is interesting to note that if the 15 watt rated lamp were operated at the DC equivalent of the 160 ma RMS current, the 400 Ohm resistor R1 would drop 64 volts (rms) which equates to 10 watts. In any event, it will be clear that the resistive ballasting provided requires a substantial increase in voltage over that required by the lamp and that, more generally, such resistive ballasting systems are highly dissipative and energy inefficient.

Turning now to a consideration of specific embodiments of the invention, the overall system of the invention can perhaps be best understood by examining each of the four interrelated subsystems makin up the overall system, viz., the ionizing power supply, the arc current power supply, the load devices, i.e., the fluorescent lamps used in the specific embodiment under consideration, and the control sub-system.

Figure 9:
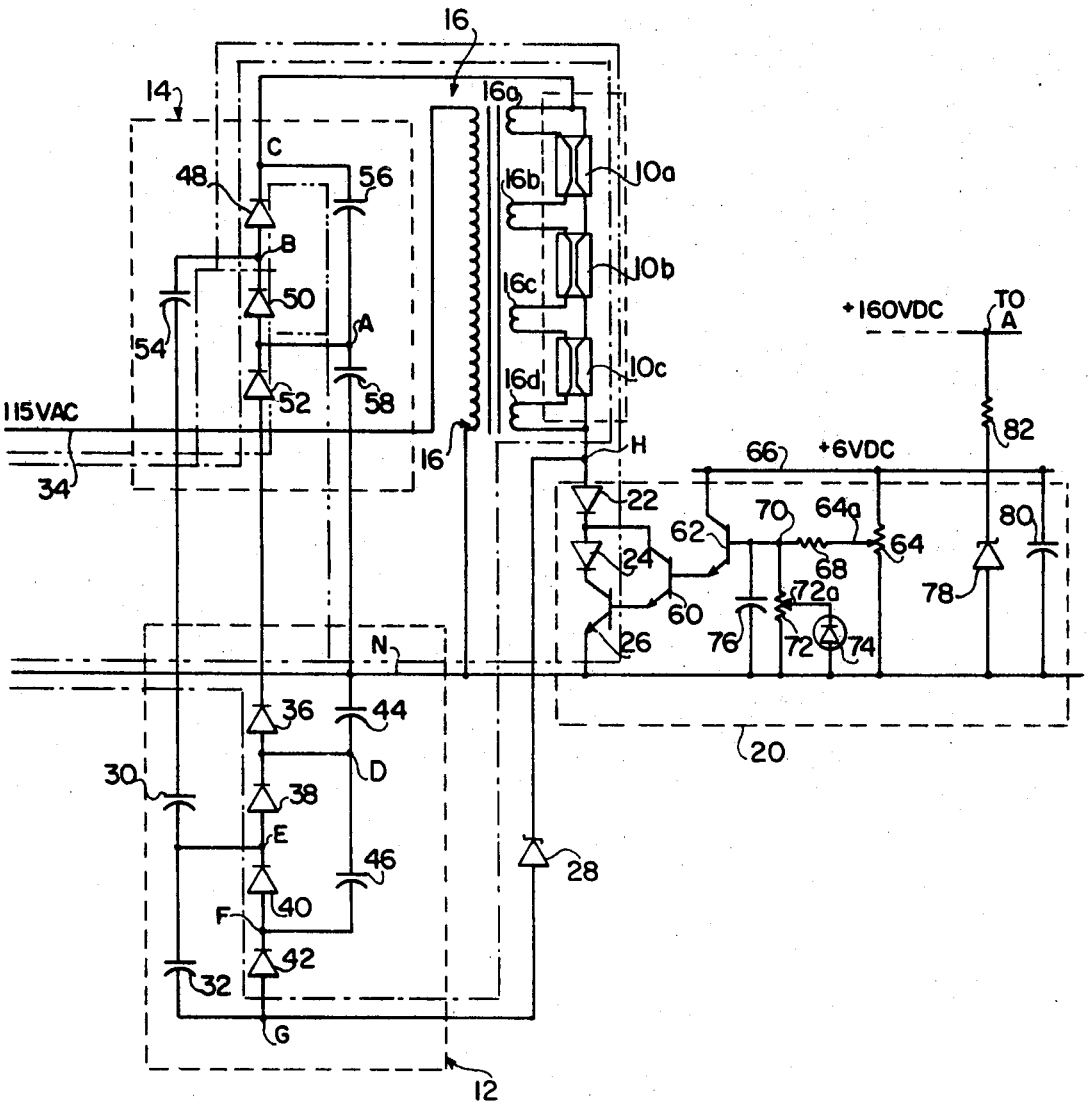
FIG. 9 is a schematic circuit diagram of a lamp lighting control system in accordance with a first embodiment of the invention.

Referring to FIG. 9, in the specific example illustrated, three fluorescent lamps, 10*a*, 10*b*, and 10*c*, collectively denoted 10, are to be ionized so an electrical discharge can be struck and a few hundred micro-amperes of current permitted to flow. The ionizing power supply, which is indicated by dashed line block 12, and the arc current power supply, which is indicated by dashed line block 14, will be described hereinbelow.

The lamps 10 are of the heated cathode type having filaments which are independently heated via the multiple secondary windings 16*a*, 16*b*, 16*c*, and 16*d* of a transformer 16. Independent heating of the electron emitters of the lamps 10 is provided for the reasons set forth in the general discussion above. Further, although the adjacent lamp heaters are shown as being connected in series with the associated transformer winding, in what is probably a preferable design the adjacent lamp filaments would be connected in parallel.

One end of the lamp series 10, designated as point H, is connected to a system neutral line N through a diode 22 and a diode 24 and a transistor 26 of a control subsystem (transistor ballast) generally denoted 20. The other end of the lamp series 10 is connected to point C of the arc current power supply 14. Point H of the lamp series 10 is also connected through a zener diode 28 to ionizing power supply 12.

Briefly considering the make-up of the supply subsystems, the ionizing supply 12 includes capacitors 30 and 32 connected in series with the 115 V AC input line 34. Diodes 36 and 38, and 40 and 42, are connected across respective ones of the capacitors as shown. Further capacitors 44 and 46 are connected to neutral line N from the junctions between the two pairs of diodes.

Similarly, arc current supply 14 includes a series of three diodes 48, 50 and 52 as well as a capacitor 54 connected between supply line 34 and the junction between diodes 48 and 50. Another capacitor 56 is connected across diodes 48 and 50 while a further capacitor 58 is connected between the junction between diodes 50 and 52 and neutral line N.

Considering the operation of the system as described thus far, the 115 VAC current-compliant voltage source, whose output appears on line 34, is first converted into a voltage complaint source which more or less matches the volt-ampere characteristics of the fluorescent lamps 10 during operation of lamps 10 in the arc discharge region of current conduction. Specifically, a voltage compliant source is provided wherein the lower the arc current the higher the supply voltage. This is accomplished by the arc current supply circuit 14 which acts as an voltage multiplier rectifier. The capacitors 54, 56 and 58 of arc current supply circuit 14 are sized so that a low current loading the DC voltage is substantially higher than the AC line peak voltage so as to provide a reasonable voltage compliance range. With this arrangement, the DC voltage lowers non-dissipatively in a manner somewhat analogous to the changing voltage requirement of the lamps 10 in the arc discharge region. The poorly regulated voltage source provided by arc current supply circuit 14, acting in combination with the transistor control provided by transistor ballast circuit 20, in effect provides the lamps 10 with a controlled DC current source.

Figure 10:
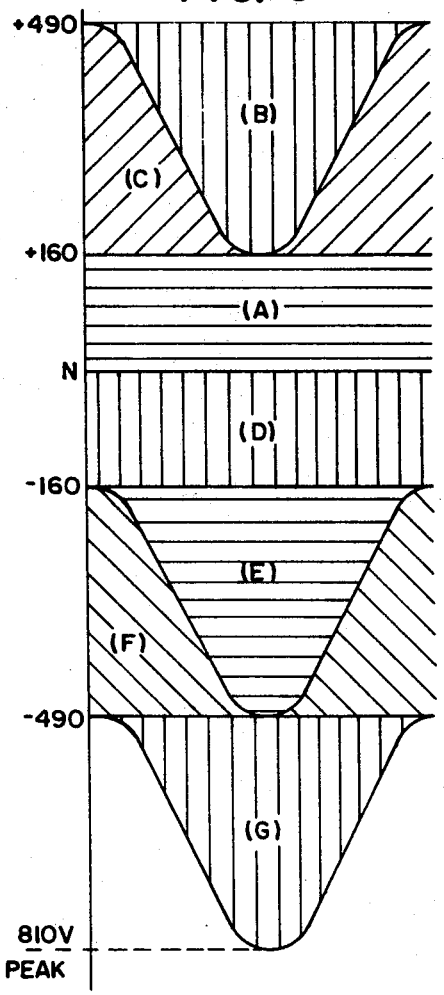
FIG. 10 is a diagram of a waveform associated with the circuit of FIG. 9.

Considering the operation of arc current supply circuit 14 in more detail, functionally diode 52 and capacitor 58 form a half-wave rectifier bridge circuit, with capacitor 58, in the specific example under consideration, being charged to the AC line peak of 160 VDC above the neutral line N. This voltage appears at point A in the FIG. 9 and is represented as voltage component A in FIG. 10. Diode 50 an capacitor 54 add a full 115 VAC peak to peak sinusoidal DC voltage to the 160 VDC which appears at point B in FIG. 9 and is identified as component B in FIG. 10. Finally, diode 48 and capacitor 56 "fill in" the positive DC voltage waveform by adding the remaining sinusiodal component C as is illustrated in FIG. 10. Thus, the voltage multiplying rectified DC arc current supply circuit 14 provides a nominal 490 VDC poorly regulated voltage source, with diode 52 and capacitor 58 forming a 160 volt DC supply and diodes 50 and 48, together with capacitors 54 and 56, forming an AC line voltage multiplier circuit that adds approximately 320 VDC to the +160 VDC half wave supply. In an exemplary circuit, 240 MFD capacitors were used which permitted lamp operation up to 700 ma of arc current.

Before the lamp current can be controlled, the lamps 10 must, of course, be ignited and ionizing supply 12 is provided for this purpose. Ionizing supply 12 basically comprises a half wave rectifier circuit and a full voltage multiplying rectifier circuit, similar to the positive voltage source previously discussed, together with one half of another voltage multiplying rectifier circuit. The specific components of ionizing supply 12 were described above, and referring to the FIGS. 9 and 10 together, the negative half wave circuit formed by diode 36 and capacitor 44 provides the no load voltage component D of the waveform shown in FIG. 10. The no load voltage components E and F are provided by the full voltage multiplier rectifier circuit formed by diode 38 and capacitor 30 and diode 40 and capacitor 46. Finally, component G is provided by the half wave voltage multiplier rectifier circuit formed by diode 42 and capacitor 32. Thus, in the specific embodiment under consideration, a negative-going no load nominally 810 volt peak DC supply is provided. This voltage, in conjunction with the positive low ripple 490 AC volts produced by the arc current supply 14 provide adequate voltage to ionize the mercury in lamps 10 so that the lamps can be started.

Capacitors 30, 32, 44 and 46 are very small, e.g., 0.005 MFD in a specific example, so that so soon as the lamps 10 fire the negative voltage drops back essentially to the negative half wave of the AC line, with at most a few micro-amperes of average current flowing in the negative supply. Zener diode 28 is employed so that with the voltage drop thereof, in combination with the poor regulation of the negative supply, there is insufficient voltage for the system to "run away". It is noted that a small one or two megohm resistor used in place of the zener diode 28 would serve the same purpose by limiting the current in the negative supply circuit to a few micro-amperes.

It is important to note that the micro-ampere starting current path, which is identified by the dot and dash line FIG. 9, shares the arc discharge current path, which is indicated by the double dot and dash line in FIG. 9, where the two lines run parallel but that the transistor controlled lamp current never flows in the negative starting circuit, i.e., in ionizing supply circuit 12, and hence diodes 36, 38, 40 42 and 28 need only be rated for micro-ampere currents.

Turning now to the transistor ballast and current control circuit 20, because point H is pulled strongly negative until the lamps 10 are ignited, the collector of transistor 26 must be protected. Point H swings positive as soon as the lamps 10 are fired since the lamps drop less voltage than the +490 VDC supply. Hence, by providing diode 22 with a 1,000 PIV rating, transistor 26 and a companion transistor 60 are protected because diode 22 is back biased when point H is negative and can only conduct when point H is pulled positive. Diode 24, which could be replaced by a simple one ohm or other low value resistor, is employed in the collector circuit of transistor 26 to insure that there is sufficient voltage between the emitter and collector of transistor 60 to permit its proper operation when and if, transistor 26 is saturated.

Transistor 26 and 60 are connected to a further transistor 62 in a high current gain configuration. The base drive for transistor 62 is provided by circuitry including a potentiometer 64 connected to a 6 VDC bus 66. The tap 64*a* of potentiometer 64 is connected through a resistor 68 to a summing point 70. A second potentiometer 72 is also connected to summing point 70, with the tap 72*a* of potentiometer 72 being connected to a photodiode 74. A capacitor 76 is connected across potentiometer 72 between the base of transistor 62 and neutral line N. It is evident that transistors 26 and 60 will have to have a sufficiently high collector-to-emitter voltage rating to withstand the positive voltage remaining after the lamp voltage drop. Because the collector of transistor 62 is connected to the positive 6 VDC bus 66 with respect to neutral line N, the collector-to-emitter voltage withstand rating thereof only needs to be a few volts. The three transistors 26, 60 and 62 are, as noted, essentially connected in a high current gain configuration with a nominal overall beta of 5,000 or more. Transistors 26, 60 and 62 are deliberately chosen as NPN transistors so that the base of the signal input transistor 62 does not turn the transistors on until the base signal voltage is one or more volts above the emitter voltage of transistor 26. This signal must be higher than the sum of the voltage drops across the emitter-base diodes of transistors 26, 60 and 62. With the configuration shown, the single plus 6 VDC control supply bus 66 serves to generate both the reference and feedback signals as will now be explained.

Summing mode resistor 68 derives a signal from the reference signal potentiometer 64. It will be appreciated that an adjustable resistance is not actually required and an appropriately valued resistor, corresponding to resistor 68, could be tied directly to the bus 66 in certain systems. In operation, the current signal of potentiometer 64 flows from the plus 6 VDC bus 66 through resistor 68 into the base of transistor 62 to thereby turn on transistor 62 and transistors 60 and 26. Thus, a controlled current, other than the miniscule starting current, is allowed to flow through the lamps 10. It is noted that all of current flowing in resistor 68 does not go into the base of transistor 62, in that some of the current will continue to flow through potentiometer 72 to neutral. The voltage level above neutral at the junction 70 between resistor 68 and potentiometer 72 must be greater than the emitter-base diode drops of transistors 26, 60 and 62 for a base current to flow into transistor 62. Once current begins to flow in the lamps 10, light is generated and photodiode 74 (which can be replaced by any suitable configured photosensitive device) receives some of the lamp generated light, together with whatever light is produced by other sources, so as to permit more of the reference signal current to flow therethrough to neutral line N rather than flow into the base of transistor 26. Thus, a closed loop is provided and the current through lamps 10 is dependent on the light received by photodiode 74.

Considering some of the secondary features of circuit 20, capacitor 76 serves to average abrupt changes in light levels as detected by the light feedback photocell or photodiode 74. Photodiode 74 is connected to the wiper arm 72*a* of potentiometer 72 to provide a feedback signal gain adjustment which may be required depending on the positioning of the photodiode 74.

The 6 volt supply provided by bus 66 is derived by using a 6 volt zener diode 78 having a capacitor 80 connected in shunt therewith. Zener diode 78 is connected through a further resistor 82 to the plus 160 volt bus provided at point A in arc supply circuit 14. Resistor 82 is sized so that the 6 V bus can supply at least 10 ma of current to transistor 62 and potentiometer 64 when the actual voltage provided by 160 VDC bus is reduced under maximum load. The 6 volt bus can also be generated by connecting resistor 82 to the 115 VAC line 34 to form another half wave DC supply. In this embodiment, a blocking diode (not shown) would be inserted in series with resistor 82 to prevent discharge of capacitor 80 during the negative half of the AC line cycle.

Under the circumstances described with the system operating with the lamps on, the controlled lamp current will increase as long as the lamp contribution declines with time so that the light incident on the photodiode 74 declines. For example, if the temperature is reduced, the light output for the same lamp current will be less due to a reduction in the mercury ion population. Likewise, the light output is reduced as the internal phosphor coating "wears", thereby resulting in less photons being emitted. In either or both of these instances, and within the system design limit, the light feedback photodiode 74 receives less light, thus resulting in an increased base drive for transistor 26 and a corresponding increase in the lamp current. Hence, again within the design limits of the system, the control sub-system 20 continuously adjusts the lamp current so as to hold the light output constant or in some other relation to the input signal reference. Thus, the system of the invention can be said to differ from prior art systems in that light rather than current is the controlled variable.

Figure 11:
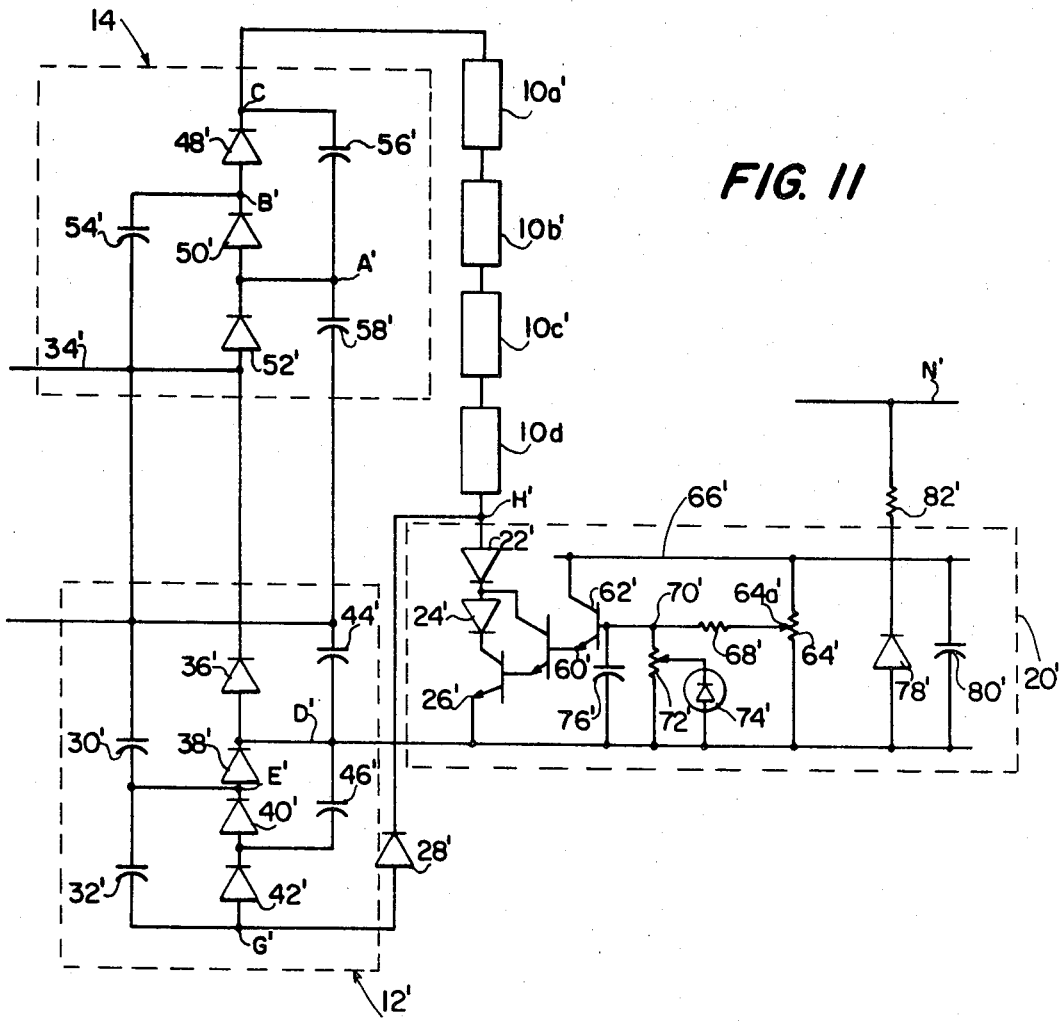
FIG. 11 is a schematic circuit diagram of a lamp lighting control system in accordance with a further embodiment of the invention.

Referring to FIG. 11, a further embodiment of the invention is illustrated. The embodiment of FIG. 11 is very similar to that of FIG. 9 and like elements have been given the same number with primes attached. The embodiment of FIG. 11 differs from that of FIG. 9 in that four rapid start fluorescent lamps are employed. The fourth lamp is denoted 10*d* and the cathodes and heater transformers have been left out for purposes of clarity. The four lamp system of FIG. 11 will, of course, require more voltage than the three lamp system of FIG. 9 and rather than choosing to increase the plus 490 VDC supply, the transistor ballast and control system 20' is disconnected from neutral line N' and reconnected to the minus 160 bus provided at point D' in ionizing circuit 12'. With this arrangement, diode 36' and capacitor 44' become part of the control current voltage source supply so the diode 36' must be capable of handling the controlled arc current. Capacitor 44' would have the same rating as capacitors 54', 56' and 58'. The remaining high voltage negative supply has been found sufficient for starting purposes.

Figure 12:
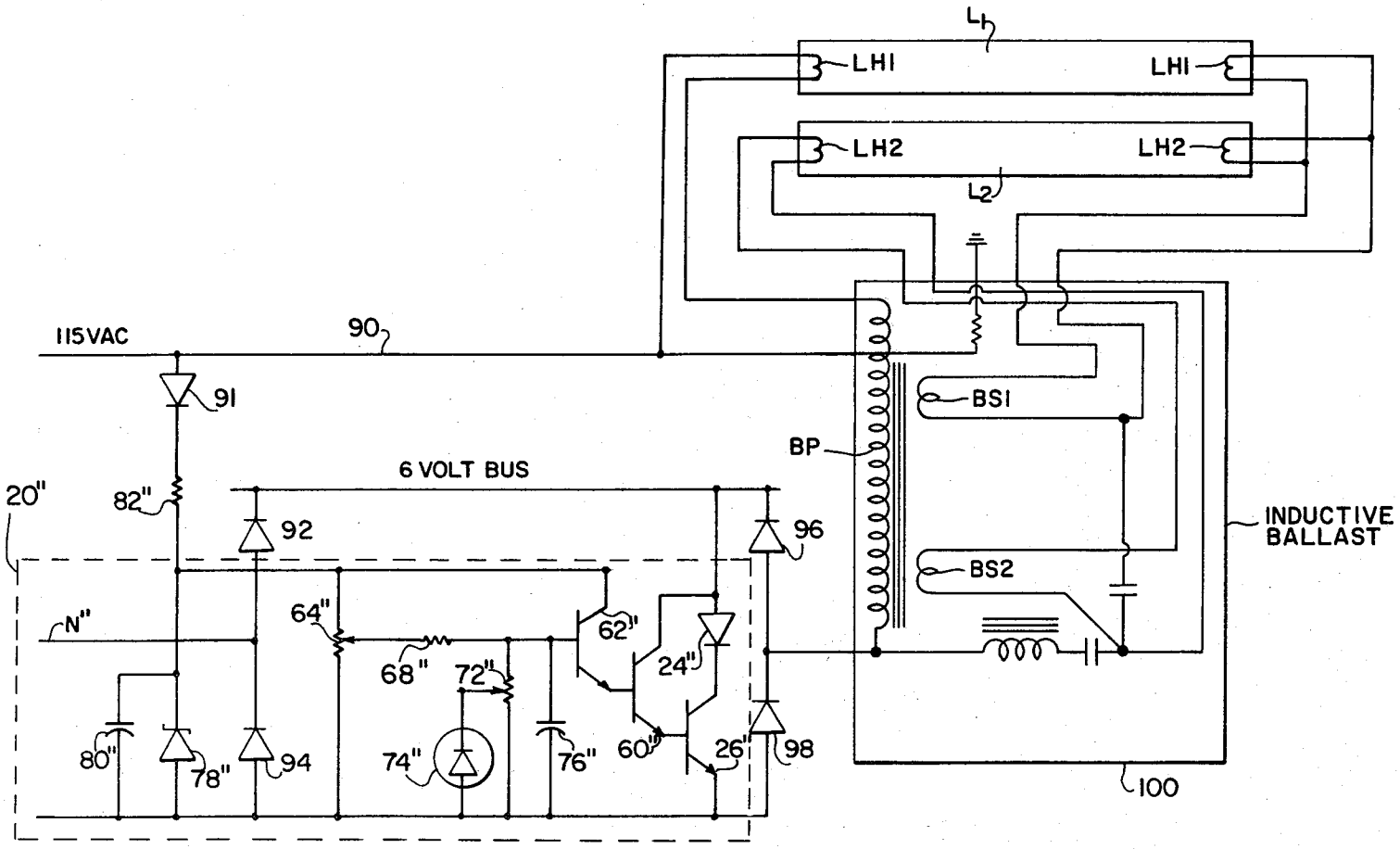
FIG. 12 is a schematic circuit diagram of a further embodiment of the invention adapted for use with a pre-existing inductive ballasting system.

Referring to FIG. 12, a further embodiment of the invention is illustrated. As explained hereinbelow, millions of fluorescent lamp fixtures are presently in operation which already include ballasts. In accordance with this aspect of the invention, additional ballasting is combined with the already existing ballast so as to provide a very significant energy savings. In brief, these savings would be reflected in savings in peak lighting (35% in a specific example) as well as off-peak lighting (30% in the same example), in air conditioning energy, in reduced demand charges and in additional heating energy charges.

In FIG. 12, the transistor ballast (control sub-system) of FIG. 9 is utilized in combination with a conventional inductive ballast 100. The transistor ballast is connected in a full wave AC diode bridge formed by diodes 92, 94, 96 and 98 and is formed by components which are similar to those described above in connection with the transistor ballast of FIG 9 and which are given the same reference numerals with double primes attached. As illustrated, the junction between diodes 92 and 94 is connected to neutral line N while the collector of transistor 62" is connected to a 6 volt bus provided by a 6 volt Zener diode 78", resistor 82" and a further diode 91 being connected to the 115 volt AC line 90 as shown.

Inductive ballast 100 is a standard two lamp, rapid start, series sequence ballast and includes the requisite lamp wiring for a pair of lamps $L_1$ and $L_2$. As shown in FIG. 12, ballast 100 includes a primary winding BP and a pair of secondary windings or taps BS1 and BS2 connected to the pairs of lamp cathode heater elements LH1 and LH2 of lmaps $L_1$ and $L_2$ as shown. Ballast 100 is completely conventional in construction and is similar to the typical series-sequence ballast utilized by Westinghouse Electric Corporation Fluorescent and Vapor Lamp Division, in their Rapid Start Lamp.

In operation, the transistor ballast of FIG. 12 limits the ballast current more or less to a controlled amplitude square wave AC current so as to produce a corresponding light output. The current flow through the system alternates between two paths. Specifically, during a first AC half cycle, the current flows through diode 92, diode 24", transistors 26" and 60" and diode 98. On the other hand, during the alternate AC half cycle, the current will reverse and flow through diode 96, diode 24", transistors 26" and 60" and diode 94.

It will be understood that the system of FIG. 12, similarly to those described above, provides DC control to control the output of the lamps, this being accomplished by locating the transistor ballast and feedback current within a full wave diode bridge (formed by diodes 92, 94, 96 and 98) connected in series with one side of the AC line 90 which feeds inductive ballast 100. Moreover, considering the operation further, it is very important to note that when the lamps $L_1$ and $L_2$ are not conducting at the beginning and end of each AC half cycle, the nature of the ballasting system is such that control transistor 26" is saturated on. Thus, apart for second order effects, the inductive ballast 100 provides the full open circuit voltage for firing the lamps $L_1$ and $L_2$ as well as for heating the lamp filaments. Once the lamps $L_1$, $L_2$ are fired, the current is limited by the control transistor 26" which then operates in the active region thereof. On the other hand, whenever transistor 26" is saturated, the inductive reactance of the ballast 100 provides the required current limiting. Thus, the transistor circuit acts as the system ballast over the dynamic range of current control, i.e., for minimum arc current up to a design current maximum, with the voltage across transistor 26" decreasing with increasing arc current flow therethrough until saturation occurs. At this point, i.e., at the current design limit, the transistor ballast is ineffective as a ballast i.e., ceases to function as current limiter, and the inductive ballast 100 then provides the system current limiting. Hence, the function of the inductive ballast is changed from one of current limiting throughout the entire operating cycle to one of providing a cost effective voltage source for firing the lamps and providing the necessary sustaining voltage. It will be appreciated that the power losses associated with the inductive ballast 100 are greatly decreased with the incorporation of the transistor ballast of the invention in that, with the inductive ballast 100 operating at less than full load, the losses are less.

It is noted that minor additions to the circuits described may be necessary or helpful in improving the operation. Thus, because in the circuit of FIG. 9 the current through the lamp series 10 is direct current noticeable lamp end light falloff may occur due to ion migration to one end of the lamps 10. Such falloff will depend on the lamp array, the length of the gas column (and hence the lamp length), the arc current density and the lamp on-time interval. If such light falloff occurs, it can be dealt with by a periodic reversal of point H to point C and vice versa. This can be accomplished with a simple polarity reversing relay such as a Potter Bromfield GM-11 which performs the switching function as soon as the system is turned off.

It will be understood that arc current control provided in the embodiments of FIGS. 9, 11 and 12 differs from that provided by a resistive ballast in that, inter alia, the maximum power is dissipated in a resistive ballast when the lamp current is highest. In all embodiments of the invention described above, minimum power is dissipated in the transistor ballast when the lamp current is highest because the transistor is then saturated on. As the lamp, and thus the transistor, current increases the emitter-collector voltage across the control transistor decreases down to its saturation voltage of less than one volt at which time the system becomes intrinsically ballasted by being voltage limited. In other dissipative ballasts, maximum power is dissipated at high arc current levels.

It will be understood that while the specific circuits discussed above provide certain advantages, other circuitry could also be employed. For example, other solid state power supplies could obviously be used for the transistor ballast control circuit and the control circuit could also use operational amplifiers and photo-voltaic or photo-resistive components as well as other components in other configurations. Typically, a 30 or 40 or more milliampere constant current could be generated and steered either to the base of the control transistor or to the neutral or minus bus as a function of a reference signal and the light level. Similarly, other forms of ionizing circuitry could be employed.

As was briefly discussed above, in all of the system embodiments, the sensed light can be either that produced by the lamps themselves and/or that from other sources such as daylight. The daylight or "other source" light in effect will generate a turn down signal.

Stated differently, as the intensity of other optically coupled light sources increases, the system arc current will be decreased or turned down. If the intensity of other source light is sufficiently high the controlled arc current will go to zero. On the other hand, the arc current automatically increases as the light from that source declines. The nature of the systems of FIGS. 9 and 11 is essentially non-dissipative when the ballast transistor is saturated and minimally dissipative, in a declining fashion, when the transistor is operating in the linear control region.

Except for its initial turn on charge, the transistor ballast takes power from the AC line in relation to the lamp current density. Of particular importance in a DC embodiment is the fact that the voltage source declines as the lamp current increases since this decline reduces the power that the transistor ballast must dissipate. Thus, a more efficient energy conserving light system is made possible. For example, in an instance where external source light is sufficiently high to turn down the controlled arc current to zero, the power consumption would be reduced about 90% from what it would have been with the design maximum arc current. The quiescent power is, of course, required for the ionizing supply, the lamp heater transformer and the control power supply.

Referring again specifically to the embodiment of FIG. 9, the polarities of the voltage source and the ionizing supply 12 could, of course, be reversed with an accompanying use of PNP type transistors in the control sub-system 20. Alternatively, the ionizing and arc current supplies could be a single circuit located on one side of neutral. However, in such a configuration the voltage from ground would be higher and the controlled arc current path would have to flow through the ionizing supply which would require that more expensive components be used in the ionizing supply.

Figure 13:
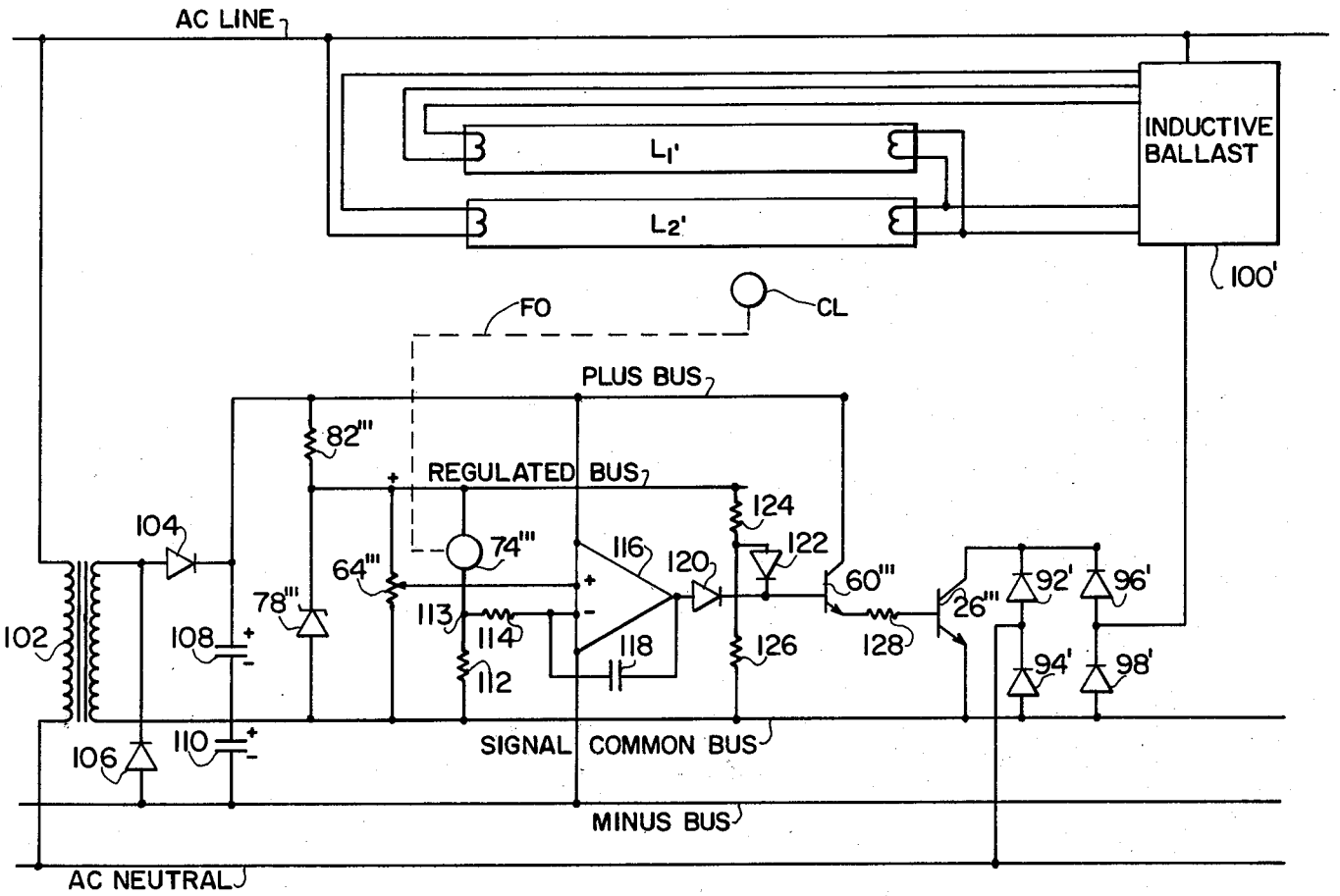
FIG. 13 is a schematic circuit diagram of a further embodiment of the invention which is of the type shown in FIG. 12.

Referring to FIG. 13, an embodiment is illustrated wherein the basic arc control circuit discussed above is altered so as to use an operational amplifier and a transformer power supply as was suggested previously. In FIG. 13, those elements which are similar to those of FIG. 12 are assigned to the same reference number with a prime (') or a triple prime (''') attached thereto while new components are assigned new reference numerals. In this manner the similarities and departures between the embodiment of FIG. 12 and the embodiment of FIG. 13 can easily be seen.

Considering the power supply portion of FIG. 13, a transformer 102 steps down the line voltage (which may be 116 VAC, 277 VAC or other available line voltages) to a 10 VAC voltage appearing on the isolated secondary winding thereof. A diode 104 acts as a half wave rectifier so as to permit the positive half circle of the secondary voltage to charge a capacitor 108 connected across the secondary to a level approximately 14 VDC above the voltage of the common bus, referred to hereinafter as the signal common. This voltage level will hereinafter be referred to as the plus or positive supply. A further diode 106 permits the negative half cycle of the 10 VAC secondary voltage to charge a capacitor 110 to a level approximately 14 VDC below signal common, which level will hereinafter be referred to as the minus supply. A resistor 82''' is connected in series combination with a zener diode 78''', with zener diode 78''' being connected to the signal common bus and resistor 82''' to the plus supply, as shown, in order to provide a regulated voltage above the signal common voltage above for signal generation purposes.

The use of a plus and minus power supply is desirable, (although a single sided supply can be employed), when an operational amplifier 116 is substituted in place of the sum point transistor 62' shown in FIG. 12. The employment of such an operational amplifier, whether used in an virtual ground summing mode or a differential input configuration, has numerous advantages including the exceedingly high gain attributes of most operational amplifiers. FIG. 13 shows operational amplifier 116 connected in a differential input configuration. The setting of a potentiometer 64''' provides a reference signal at the plus input of operational amplifier 116. A light controlled variable resistance photocell 74''', which is connected to a resistor 112 and a resistor 114 as shown, is connected to the minus input. Before proceeding, it should be noted that the function of potentiometer 64''' can also be replaced by a remote program signal, signal generator or the like in an application requiring remote adjustment of the reference signal.

When photocell 74''' and resistor 112 are connected in a circuit between signal common and the plus regulated bus, they act as a voltage divider wherein the amplitude of the voltage at their junction node 113 will vary from almost zero volts (with photocell 74''' in darkness) to almost that of the plus regulated bus (in bright light). As noted above, junction node 113 is connected to the minus input of operational amplifier 116 through resistor 114. Resistor 114 is part of an RC time constant network that further includes a capacitor 118. This network helps to prevent abrupt changes in the output of the system where this is desirable. Alternatively, for a faster response system, the RC network might be modified to different component values or be removed with the minus input of operational amplifier 116 can be connected directly to the junction of photocell 74''' and resistor 112.

The output of operational amplifier 116 is connected to the plus and minus supplies and to a further diode 120. The latter is also connected to a diode 122 whose anode is also connected to the junction of a pair of voltage divider resistors 124 and 126.

The values of resistors 124 and 126 are selected such that the junction voltage, i.e., the voltage on the anode of diode 122, provides a minimum "on" signal through diode 122 to a transistor 60'''. Hence, transistor 60''' is "on" at some minimal level related to the voltage division of resistors 124 and 126 whenever the system has AC line power.

Transistor 60''' drives a control transistor 26''' via a resistor 138 which acts as a current source to minimize component thermal drifts and the like. Transistor 26''' normally operates in the active region, thereby limiting the current in the ballast primary only when the lamps are ignited. However, transistor 26''' is effectively saturated "on" during the "lamps off" portion of the AC cycle so full magnetizing and lamp filament current is provided at least up to lamp ignition. To reiterate, it is important to understand that, except for the minor losses in the bridge across and saturated transistor 26''', the full line voltage is applied to the ballast 100' until the lamps ignite. Hence, the ballast 100' is provided with magnetizing current and the lamps have their rated cathode current when applicable. The bridge diodes 92', 94', and 98' rectify the AC of the ballast 100' and transistor 26''', being located in the DC leg, permits the previously described DC control techniques to be employed.

When the lamps $L_1$ and $L_2$ ignite, the load applied to the secondary (not shown in FIG. 13) of the inductive ballast 100' is reflected to the primary not shown in FIG. 13) and an increase in primary current is demanded by the lamps. The base drive set by the light loop, determines the amount of collector current that is allowed to flow through transistor 26'''. Therefore, when the current demand of the lamps is not satisfied by transistor 26''', the voltage across the primary of the ballast 100' falls. At the same instant in time, this drop is ballast primary voltage is applied to the collector-emitter circuit of transistor 26'''. This voltage, when added to the ballast primary voltage, equals the line voltage until the lamps are extinguished further on in the half cycle. At this later time, the voltage from the collector to emitter of transistor 26''' is reduced to a minimum and transistor 26''' therefore reverts to a saturated condition.

The signal information for the closed loop is thus generated at a 120 Hz rate for a 60 Hz system and a 100 Hz rate for a 50 Hz system, and in approximately 6 millisecond bursts from the lamps for a 60 Hz system and in 8 milliseconds bursts for a 50 Hz system. These bursts of light are averaged by the time constant circuit associated with operational amplifier 116.

Briefly considering the operation of the embodiment of FIG. 13, when the system is energized with either 115 VAC or other line voltages, current flows through the primary of ballast 100' and two of the diodes 92', 94', 96', and 98', depending on the polarity of half cycle of the AC input. Further, transistor 26''' is conducting, transistor 26''' being "saturated on" by the reference signal derived from potentiometer 64''', providing that this reference is sufficient to drive the output of operational amplifier 116 to a voltage level sufficient to back bias diode 122. Alternatively, if the output voltage of operational amplifier 116 is insufficient to back bias diode 122, the minimum signal provided by diode 122 will back bias diode 120, with diode 122 providing a minimum signal from voltage divider resistors 124 and 126 to transistor 60'''. The signal from diode 120 or diode 122 turns on transistor 60''' through resistor 128 and transistor 26''' is saturated "on" as long as the lamps have not ignited. It is noted that a transistor is saturated "on" when that transistor has sufficient minority carriers in the base region so as not to limit any current which would flow through the collector diode. Expressed another way, the collector current of the transistor is now unlimited and will remain so to the extent of the availability of minority base region carriers.

For this saturated condition of transistor 26''', the primary of ballast transformer 100' essentially receives the full line voltage and the saturated transistor 26''' conducts the magnetizing current of ballast 100' (together with the load current of the lamp heaters if rapid start lamps are used). After the cathodes in lamps $L_1$ and $L_2$ are heated, and the halfwave AC lamp voltage rises to a firing level, the lamps ignite. Current through lamps $L_1$ and $L_2$ then rises to a level dependent on base drive of transistor 26''', as explained hereinabove. Once this current level is reached, the transistor 26''' comes out of saturation and the current flow is now limited. At this time, the circuit voltages adjust due to the fact that the change in circuit current ceases. In particular, as the AC halfwave ballast primary voltage falls, the difference between the line voltage and this ballast primary voltage appears across transistor 26'''. This adjustment in voltage continues such that the sum of ballast primary voltage and transistor voltage equals the line, i.e., the instantaneous supply voltage voltage until the lamps extinguish. This occurs each time the AC halfwave declines to a nonsustaining arc level. At this time the circuit current will begin to be less than the regulated value and transistor 26''' then resaturates and the collector-emitter voltage reaches a saturation minimum. The ballast primary voltage is then once again equal to the line voltage minus the small saturation voltage of the saturated transistor-diode bridge combination.

The operation of the circuit of FIG. 13 described above is repeated during a part of each half cycle of the line voltage depending on the duration of the current limiting period. The base drive or regulated collector current of transistor 26''' is set by the closed loop completed through lamps $L_1$ and $L_2$ and photocell 74'''. The loop response is slowed down by the RC network formed by resistor 114 and capacitor 118 such that fast changes in light level are averaged over a several second time period. However, as noted above, the loop can also have a fast response by providing adjustments to, or the elimination of, the RC network.

The value of current limiting provided in response to a related light level is set by setting the tap or wiper of potentiometer 64''' to produce the desired output voltage. Feedback is provided by sensing the light output from the lamps $L_1$ and $L_2$ and/or some other light components via a light collecting lens CL attached to a bundle of fiber optics FO to transmit a measure of the ambient light level at a given location to photocell 74''' generally located with the control circuitry within a lamp fixture without using electrical conductors. This insures that the selected lamp current will be limited to a level related to the reference signal level. In operation, the feedback light produces a voltage at the junction of photocell 74''' and resistor 112. Assuming that light is falling on photocell 74''', this voltage increases until it is virtually equal to the potentiometer voltage at the positive input of operational amplifier 116. The almost zero difference voltage referred to constitutes the signal which produces the regulated current through lamps $L_1$, $L_2$. The light output of the lamps $L_1'$, $L_2'$ may be increased or decreased by changing the reference level signal provided by potentiometer 64''' within the bounds of the lower limit set by the voltage at the junction of resistors 124 and 126 and the upper level set by the inherent current limiting of the ballast 100'. Whenever the current limit of ballast 100' is reached, transistor 26''' is again saturated "on".

It is noted that in the embodiments described previously the minimum level signal is established by adjustment of the reference or command signal potentiometer (element 64) so as to establish a minimum reference signal level at the transistor summing point. To summarize, a key feature of the system of the invention in all illustrated embodiments thereof, is that the control transistor is saturated "on" for the period of time during each AC half cycle that the lamps are not ignited. Therefore, firing of the lamps is not inhibited and once the lamps fire, the control transistor then operates in a new unsaturated linear range up to the point that the ballast limits the current. Further, with the use of a sufficient input reference signal, the ballast will provide limiting and the control transistor is again saturated with lamps "on". This sequence repeats itself each half cycle.

Figure 14:
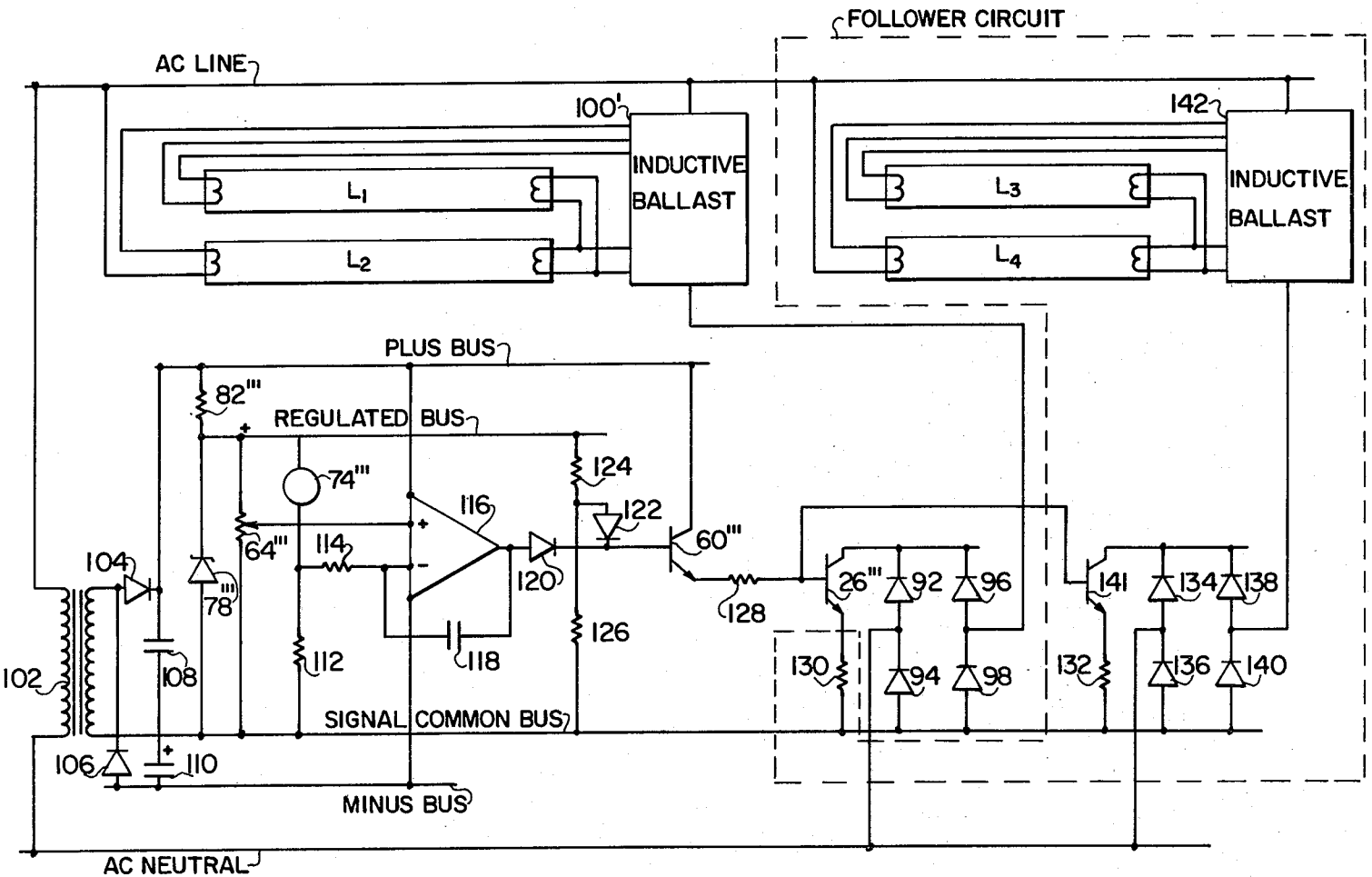
FIG. 14 is a schematic circuit diagram of yet another embodiment if the invention, as used with at least two separate sets of lamps and at least two separate ballasts.

Before considering the embodiment of FIG. 14, certain background considerations should be examined. In most instances in the commercial lighting field each pair of lamps in a fixture has an AC inductive ballast; in fact, many fixtures contain four lamps with two ballasts in the ballast compartment of the fixture. While an individual system could be used for each ballast, substantial savings might be realized if two or more ballasts could be operated from a single control system. However, in actual practice two ballasts cannot be operated in parallel from a single system because the lamp pairs, in effect, act in a manner somewhat analagous to zener diodes. Specifically, one pair inevitably ignites and thereafter, while the other pair may subsequently ignite, this pair will operate in a low uncontrolled current region so that only the pair that first reaches the arc discharge region is controlled. This behavior of paralleled ballasts is due to the arc-discharge phenomena and is a substantial obstacle to realizing the economies referred to above.

One simple but unique solution to this problem is illustrated in FIG. 14. Generally speaking, apart from the circuitry used in providing the solution in question, FIG. 14 corresponds to FIG. 13 with addition of a second pair of pairs lamps $L_3$ and $L_4$ and an associated ballast, and the same reference numerals are used for common components. In accordance with this solution referred to, another four diode bridge fomred by diodes 134, 136, 138 and 140, a control transistor 141, a pair of emitter resistors 130 and 132, are connected as shown in FIG. 14. It is noted that one of these emitter resistors, viz., emitter resistor 130, is added in the emitter leg of transistor 26''' and the base lead of transistor 141 is connected to the junction between resistor 128 and transistor 26'''. If it is assumed, for example, that when the lamps $L_1$ and $L_2$ connected to the ballast 100' ignite, the system (and the associated lamp pair) proceed to a current limited mode set by the collector-emitter current of transistor 26''' it will be seen that the collector-emitter current will generate a voltage across resistor 130 tending to reduce the base drive for transistor 26''' relative to transistor 141. This will happen unless there is a similar current flow in ballast transistir 141 whereby a matching voltage would be developed across emitter resistor 132. Therefore, the collector-emitter currents of transistor 26''' and 141 would tend towards matching due to the "emitter degeneration" caused by the emitter resistors 130 and 132. It will also be appreciated that the value of resistor 128 must be reduced so as to provide the extra current to drive the additional transistor for the second ballast.

This concept, with appropriate modification, could also be extended to include additional ballasts in other fixtures. The fixture with the sensing and reference signal circuitry will hereinafter be referred to as the "master unit" and the second ballast and/or other fixtures with other ballast(s), together with their full wave bridges and control transistors with emitter resistors, will hereinafter be referred to as "follower units". The power supply, as well as transistor 60''' of the master unit, must be suitably rated to provide sufficient signal levels to accomodate the needs of a plurality of control transistors. Electro-optical devices can also be employed to eliminate wiring used in conductive coupling between master and follower units.

Figure 15:
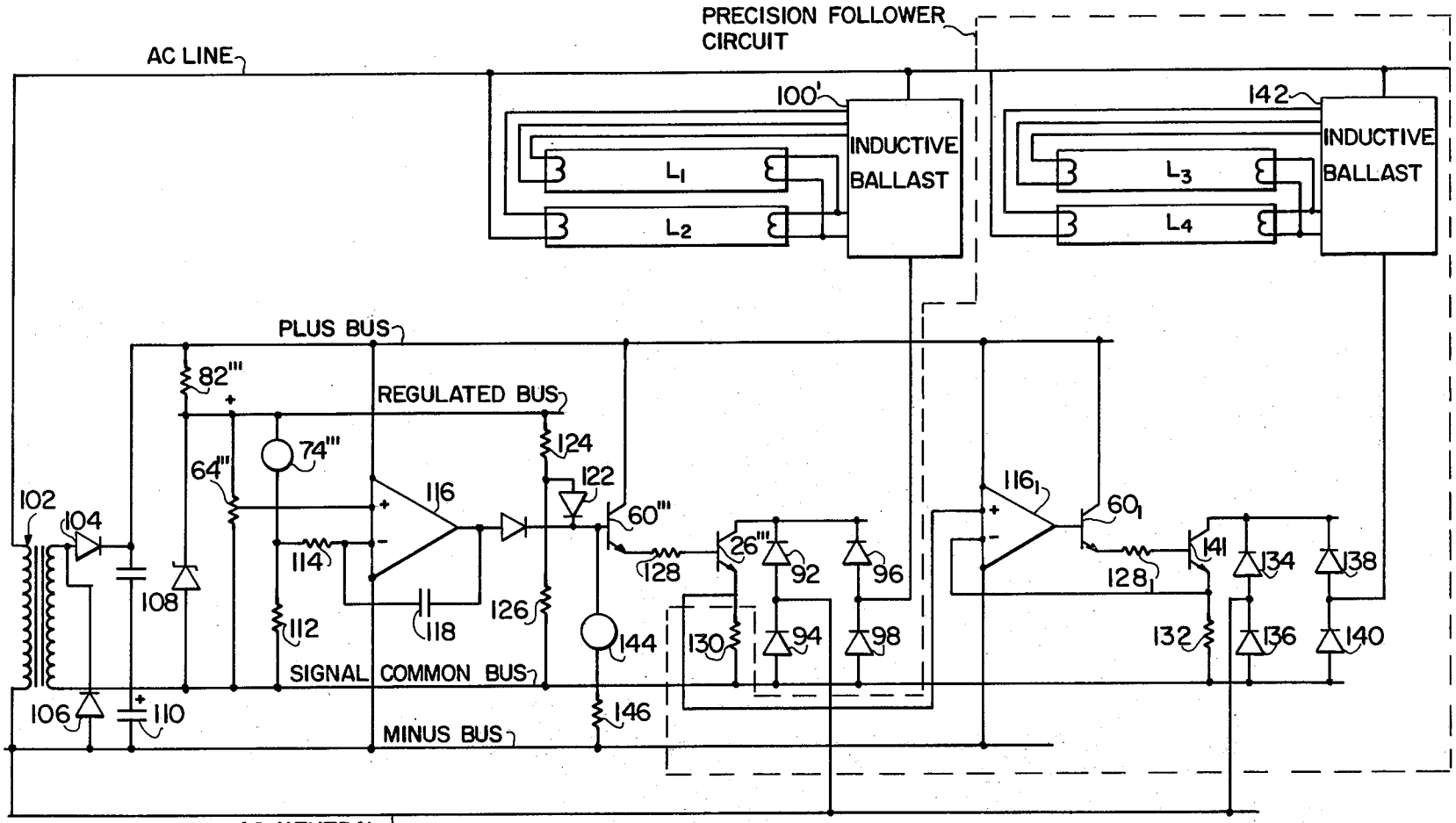
FIG. 15 is a schematic circuit diagram of a further embodiment of the system of FIG. 14.

Referring to FIG. 15, another embodiment of the master-follower concept is illustrated. FIG. 15 is similar to FIG. 14 and like elements have been given the same reference numerals. The advantage of the embodiment of FIG. 15 over that of FIG. 14 is that the currents flowing in the primaries of the one or more follower ballasts are more precisely matched or scaled. In addition to the components added in FIG. 14, a further transistor $60_2'$ and further operational amplifier 116' are also incorporated in the follower circuit. The reference signal supplied to the plus input of operational amplifier 116' is derived from the voltage generated across emitter resistor 130 and the feedback of minus base input to operational amplifier $116_2'$ is derived from the voltage generated across emitter resistor 132. With a rated forward voltage gain of 50,000, operational amplifier $116_2'$ provides maximum output for less than a millivolt of differential signal input. Because of this, the embodiment of FIG. 15 provides precise current matching or scaling of a plurality of ballast currents. The transistor currents can be scaled by providing an appropriate ratio between the values of the respective emitter resistors.

As discussed above, follower units could be provided for many ballasts with interconnecting signal wiring from the master unit or optical coupling devices. Alternatively, by using the AC line as a carrier, signals can be coded and transmitted and thereafter received and decoded at selected fixtures. The current matching capability of the circuit of FIG. 15 is so precise that the full wave bridge formed by diodes 134, 136, 138 and 140 and the second ballast 142 could be eliminated and the collector of transistor 141 connected directly to the collector of transistor 26''' so as to increase the current capacity of the master unit. This would be particularly useful with the higher current ballasts employed with higher current arc discharge lamps or as a simple method for connecting a plurality of output stage transistors in parallel to provide a unique high current source capable of handling up to a hundred or more amperes.

Returning again to commercial lighting systems, another problem related to energy savings is what might be termed the light turn on/turn off problem. This occurs, for example, when someone forgets to turn off the lights when leaving an area and/or when maintenance personnel turn lights on after hours for longer than necessary. Some buildings are now equipped with light turn-on and turn-off programs and many software programs and/or sensors are available for doing the same thing. However, the cost of the magnetic contactors, housings, power handling wiring and other power switching problems inhibit the provision of automatic programming for light systems. However, with a system in accordance with the present invention in place, a computer signal delivered to any master or single unit could shut off the lights controlled thereby by the addition of simple circuitry which would serve to pull the base of transistor 60''' in FIG. 15 negative to the point of providing shut off. In a simple example illustrated in FIG. 15, a photo-transistor or other optical device, denoted 144, is connected to the base of transistor 60''' and to a resistor 146 connected to the minus 15 volt power supply bus. With this arrangement, the software program referred to above would, at the appropriate time, energize a light emitting diode (not shown) to switch the photo-transistor 144 "on", thereby pulling the base of transistor 60''' negative to the point of cut off. This would of course turn off transistor 26''' and terminate flow of the ballast magnetizing currents and hence cut off power to the lamps.

Although the present invention is particularly applicable to illuminating light, the invention would also be useful in many photographic and other technical or scientific applications where light control is of a definite advantage. As stated, a simple yet highly efficient energy conserving system is provided in accordance with the invention which controls the level of light from a fluorescent lamp(s) and which has applications for controlling the quantity and other characteristics of the outputs of gaseous arc discharge lamps in general, as well as special purpose load devices, over a wide dynamic operating range. The actual savings which can be realized would amount to millions of barrels of oil where the principles of the invention were utilized on a sufficiently widespread basis.

It will be appreciated that although an inductive ballast is shown in the specific embodiments illustrated, other ballasts can be employed and that the term "reactive ballast" as used in this application refers to inductive or capacitive ballasts.

Although the invention has been described relative to exemplary embodiments thereof, it will be understood that other variations and modifications can be effected in these embodiments without departing from the scope and spirit of the invention.

I claim:

1. A fluorescent lamp lighting system powered from an A.C. supply, said system comprising:

a first plurality of fluorescent lamps;

a first reactive ballast for said first plurality of lamps;

a second plurality of fluorescent lamps;

a second reactive ballast for said second plurality of lamps;

rectifying means connected to said A.C. supply;

a control transistor connected to said rectifying means for controlling the arc current supplied to said first plurality of lamps;

a single control unit for controlling the arc current through said first and second plurality of lamps including feedback means responsive to the output of said lamps for producing an arc current control signal related to the output of said lamps;

means for supplying said arc current control signal to said first control transistor; and follower circuit means, connected between control unit and said second ballast and including a second control transistor connected to the output of said control unit, for controlling the arc current supplied to said second plurality of lamps and including means for relating the arc current control signals applied to said first and second control transistors so that currents flowing in said first and second ballasts are in a desired relationship.

2. A fluorescent lamp lighting system as claimed in claim 1 wherein said means for relating the arc current signals provides scaling of the currents flowing in said first and second ballasts.

3. A fluorescent lamp lighting system as claimed in claim 1 wherein said means for relating said arc current signals provides matching of the currents flowing in said first and second ballasts.

4. A fluorescent lamp lighting system as claimed in claim 1 wherein said means for relating the arc current signals comprises a resistance connected in the emitter circuit of each of said first and second control circuits.

5. A fluorescent lamp lighting system as claimed in claim 4 wherein said follower circuit means includes an operational amplifier connected to said second control transistors.

6. A fluorescent lamp lighting system as claimed in claim 5 wherein one input to said operational amplifier is connected to the emitter of the first control transistor and the second input of said operational amplifier is connected to the emitter of said second control transistor.

7. A fluorescent lamp lighting system as claimed in claim 6 wherein said single control unit includes a further operational amplifier and a first biasing signal transistor connected to the output of said operational amplifier and to the base of the first control transistor, and said follower circuit means includes a second biasing signal transistor connected between the output of the first-mentioned operational amplifier and the base of said second control transistor.

8. A fluorescent lamp lighting system as claimed in claim 1 wherein said first and second control transistors act to limit and control the arc currents supplied respectively to said first and second plurality of lamps during at least a part of the portion of a half wave of said A.C. supply when said lamps are ignited and provide substantially no current limiting for values of arc current above a predetermined level.

9. A fluorescent lamp lighting system comprising:

means for providing an A.C. supply voltage;

a first set of fluorescent lamps;

a first ballast connected to said first set of lamps;

at least one further set of fluorescent lamps;

a further ballast connected to said at least one further set of lamps;

first control means connected to said first ballast for controlling the arc current through said first set of fluorescent lamps, said first control means including a first control transistor which is fully saturated on (i) for arc currents below a predetermined level and (ii) subsequent to extinguishment of said first set of lamps and prior to ignition of said first set of lamps, and which is biased such as to operate in the active region of the operating characteristics thereof subsequent to the ignition of the first set of lamps and up to said predetermined arc current level;

second control means connected to said second ballast for controlling the arc current through said second set of fluorescent lamps, said second control means comprising a second control transistor which is fully saturated on (i) for arc currents below a predetermined level and (ii) subsequent to extinguishment of said second set of lamps and prior to ignition of said second set of lamps, and which is biased to operate in the active region of the operating characteristics thereof subsequent to the ignition of the second set of lamps and up to said predetermined arc current level;

a single feedback control unit for sensing the light output of said lamps for generating a control signal for controlling said first and second transistors; and means, including first and second resistors connected to the respective emitter circuits of said first and second control transistors, for providing a desired relationship between the arc currents flowing in said first and second ballasts.

10. A system as claimed in claim 9 wherein said feedback control unit includes a first operational amplifier connected therein, said system further comprising a second operational amplifier connected to the base of said second control transistor.

11. A system as claimed in claim 9 wherein a point on the junction between the first resistor and the emitter of the first control transistor is connected to one input of said second operational amplifier.

12. A system as claimed in claim 11 further comprising fiber optic means for guiding light from at least one of the lamps to said light responsive means.

13. A system as claimed in claim 12 wherein the rectifying means, control transistor means and light responsive means are disposed in control unit located within a light fixture containing said at least one lamp from which light is guided by said fiber optic means.

14. An energy conserving lighting system comprising:

a plurality of gas discharge lamps operating in the arc discharge region thereof;

a solid state electronic control device connected in the said arc current path of said lamps;

light sensing means for sensing the total ambient light in the area of said lamps including the light produced by said lamps and the ambient light produced by all other light sources in said area and for producing an output in accordance therewith; and feedback means connected between said electronic device and said light sensing means for proportionally controlling the conduction of said electronic control device and thus the amplitude of the current in said arc current path in accordance with the output of said light sensing means so as to maintain the said total ambient light substantially constant; and a poorly regulated voltage source power supply means connected in the arc current path of said lamps for providing a decreasing supply voltage with increasing arc current.

15. A system as claimed in claim 14 wherein said poorly regulated voltage source power supply means comprises, in combination, a half wave rectifier circuit, a full wave AC line voltage multiplying rectifier circuit and one-half of a further AC line voltage multiplying rectifier circuit.

16. A system as claimed in claim 14 wherein said poorly regulated voltage source power supply means includes a plurality of diodes, and a plurality of capacitors connected across said diodes.

17. A system as claimed in claim 14 further comprising ionizing means for providing an ionizing voltage for starting said lamps so that an arc current flow therethrough, said ionizing means providing a low voltage after said arc current begins to flow through said lamps.

18. A system as claimed in claim 17 wherein ionizing means comprises a plurality of diodes and a plurality of capacitors connected across said diodes.

19. A system as claimed in claim 18 wherein said diodes are connected in series and said capacitors are connected across pairs of said diodes.

20. A system as claimed in claim 18 wherein said ionizing means is connected in a current path in parallel with that in which said electronic device is connected.

21. A system as claimed in claim 20 wherein a zener diode is connected between ionizing means and one side of the lamps in said current path in which said ionizing means is connected.

22. A system as claimed in claim 14 wherein solid state electronic device comprises a plurality of transistors connected in a high grain configuration.

23. A system as claimed in claim 22 wherein said feedback means includes a potentiometer for adjusting the input voltage level of said plurality of transistors.

24. A system as claimed in claim 22 wherein one of said transistors is connected in series with said lamps, said system further comprising a diode connected in series between said one transistor and said lamps for protecting said transistor during starting of said lamps.

25. An energy conserving light output control system for firing and maintaining arc current flow through a plurality of fluorescent lamps, said system comprising:

arc current supply means comprising a first voltage multiplying means, including a plurality of capacitors and diodes in accordance with the number of lamps, for supplying arc current to said fluorescent lamps after said fluorescent lamps have been fired;

ionizing power supply means comprising a second voltage multiplying means, including a plurality of capacitors and diodes in accordance with the number of lamps, for providing, in cooperation with said arc current supply means, an ionizing voltage for firing the lamps and for providing a low voltage after said lamps are fired;

said arc current supply means constituting means for providing a non-dissipative decline in the voltage supplied to the lamps with an increase in the lamp load current;

light sensing means for sensing the total ambient light including the light output of the lamps as well as the ambient light produced by other light sources; and feedback menas, including a solid state current control device connected in the arc current path of said lamps, for controlling the amplitude of the current in said arc current path in accordance with the output of said light sensing means so as to maintain the total ambient light at a substantially constant level.

26. A light control system comprising at least one standard rapid start-type fluorescent lamp including at least two cathode heater elements therein, at least one standard rapid-start ballast with transformer winding taps to provide voltage to said cathode heater elements to form a ballast-lamp combination, an electronic current control circuit for controlling the electrical energy supplied to said ballast-lamp combination, and an A.C. voltage source connected to said ballast and said control circuit, said electronic current control circuit including means, including at least one active electronic device, for providing that substantially full open circuit voltage for the said cathode heater elements of the lamp is supplied from the ballast during the beginning and end portions of each half-cycle of the A.C. voltage source during which the least one lamp is not conducting arc current.

27. A light control system as claimed in claim 26 wherein said means including the at least one active electronic device provides that, prior to the initial ignition of said lamp, substantially full open circuit voltage for the said cathode heater elements of the lamp is supplied from the ballast.

28. A light control system as claimed in claim 26 wherein said active electronic device comprises a control transistor which is saturated on during said beginning and end portions, said system further comprising control means for controlling amount of current conduction of said control transistor.

29. A light control system as claimed in claim 28 wherein said control means includes means for sensing the light output of said at least one lamp.

30. A light control system as claimed in claim 29 wherein said output sensing means includes a photosensor and wherein said system further comprises a fiber optic wave guide means for conducting light from said lamp to said photosensor.

31. A light control system as claimed in claim 26 wherein said active electronic device comprises a plurality of transistors connected in a high gain configuration.

32. A light control system comprising at least one standard rapid start-type fluorescent lamp including at least two cathode heater elements therein, at least one standard rapid-start ballast connected to said lamp to form a ballast-lamp combination, an A.C. supply for supplying A.C. voltage to said lamp-ballast combination, an electronic control circuit for limiting the current supplied from said A.C. supply to said lamp-ballast combination during a portion of a halfwave of said A.C. voltage, said electronic current control circuit including means, including at least one control transistor connected in a rectifying bridge connected to said A.C. supply, for providing that subsequent to initial ignition of said lamp, substantially full open circuit voltage for the said cathode heater elements of the lamp is supplied from the ballast during any time interval within the each half wave of the A.C. voltage that the electronic control circuit is not providing current limiting.

33. A light control system as claimed in claim 32 further comprising control means for controlling the operation of said control transistor, said control means including means for sensing the light output of said at least one lamp.

34. A light control system as claimed in claim 33 wherein said light output sensing means includes a photodetector and said system further comprises fiber optic waveguide means for conducting light from said lamp to said photodetector.

35. A light control system as claimed in claim 32 wherein said control transistor comprises a plurality of transistors connected in a high gain configuration.

36. A light control system as claimed in claim 32 wherein said at least one lamp comprises a plurality of said rapid start lamps each including associated cathode heater elements, said inductive ballast comprising a primary winding connected to said rectifying bridge and a plurality of secondary windings respectively connected to the cathode heater elements of said lamps.

37. A light control system comprising at least one standard rapid start-type fluorescent lamp including at least two cathode heater elements, at least one standard rapid-start ballast connected to said lamp to form a ballast-lamp combination, an A.C. supply for supplying electrical energy to said ballast-lamp combination and an electronic current control circuit for controlling the electrical energy supplied to said ballast-lamp combination from A.C. supply, said electronic current control circuit providing current limiting during a portion of a half wave of the A.C. supply and including means, including at least one active electronic device, for providing that a portion of the available A.C. supply voltage for the cathode heater elements of the lamp is supplied from the ballast during the time said electronic current control circuit is providing current limiting, the portion of the instantaneous supply voltage supplied by said ballast being equal to the instantaneous supply voltage minus the voltage in excess of that required by the lamp for the limited level of current with the said excess voltage appearing across said at least one active electronic device during the times of current limiting.

38. A light control system as claimed in claim 37 wherein said means including at least one active electronic device provides that substantially full open circuit voltage for the said cathode heater elements of the lamp is supplied from said ballast up to the time that the lamp is initially ignited.

39. A light control system as claimed in claim 37 wherein said means including at least one electronic device provides that, subsequent to the initial ignition of the lamp substantially full open circuit voltage for the said cathode heater elements of the lamp is supplied from the ballast during the time interval within the subsequent half waves of the A.C. voltage of the A.C. supply that the lamp arc is not being current limited by the said at least one active electronic device.

40. A fluorescent lamp light system powered from an A.C. supply and adapted for use with higher current ballasts employed with higher current arc discharge lamps, said system comprising:

a plurality of said arc discharge lamps;

a said reactive ballast for said plurality of lamps;

rectifying means connected to said A.C. supply;

a first control transistor connected to said rectifying means for controlling the arc current supplied to said lamps through said ballast;

a control unit for controlling the conduction said control transistor including feedback means responsive to the output of said lamps for producing an arc current control signal related to the output of said lamps and for supplying said arc current control signal to said control transistor; and means for increasing the arc current supplied to said lamps including at least one further control transistor and means for substantially matching the current flow through the first control transistor and said at least one further control transistor comprising a first resistor connected in the emitter circuit of said first control transistor, a second resistor connected in the emitter circuit of said at least one further control transistor and having a resistance value substantially equal to the resistance value of said first resistor, and an operational amplifier having an output connected to the base of the at least one further control transistor, a first input connected to a junction between said first resistor and the emitter of said first control transistor, and a second input connected to a junction between said second resistor and the emitter of the said at least one further control transistor.

41. A system as claimed in claim 40, further comprising means for directly connecting the collector of the said at least one further control transistor to the collector of said first control transistor.

42. A light control system comprising at least one fluorescent lamp including at least two cathode elements, at least one transformer ballast, including a primary winding and at least one secondary winding, connected to said at least one lamp to form a ballast-lamp combination therewith, an electronic current control circuit for controlling the electrical energy supplied to said ballast-lamp combination, and an A.C. voltage supply line connected to said ballast and said control circuit, the primary winding of said transformer ballast being connected in series with said A.C. supply line and said control circuit and said secondary winding being connected to said lamp, said electronic current control circuit including means, including at least one electronic switching device having a low impedance state and a higher impedance state, for providing a control mode of operation wherein said switching device is in the low impedance state thereof during the beginning and end portions of each half-cycle of the A.C. voltage source such that substantially full open circuit voltage is supplied to the ballast for the cathode elements of the lamp and wherein said switching device provides arc current control during a period between said beginning and end portions of each said half-cycle, said system further comprising feedback means for sensing a parameter related to the light output of said at least one lamp and for producing an electrical output signal in accordance therewith, and said electronic current control circuit being responsive to said electrical output signal.

* * * * *